US009209545B2

(12) United States Patent
Hemmi et al.

(10) Patent No.: US 9,209,545 B2
(45) Date of Patent: Dec. 8, 2015

(54) TERMINAL HAVING AN INSERTION GROOVE FOR A CONDUCTOR AND A PAIR OF CONDUCTIVE ARM PARTS WITH A PLURALITY OF SLITS

(71) Applicant: OMRON CORPORATION, Kyoto-shi (JP)

(72) Inventors: Yoshinobu Hemmi, Otsu (JP); Hirotada Teranishi, Osaka (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 14/240,819

(22) PCT Filed: Oct. 12, 2012

(86) PCT No.: PCT/JP2012/076497
§ 371 (c)(1),
(2) Date: Feb. 25, 2014

(87) PCT Pub. No.: WO2013/054908
PCT Pub. Date: Apr. 18, 2013

(65) Prior Publication Data

US 2014/0213125 A1 Jul. 31, 2014

(30) Foreign Application Priority Data

Oct. 14, 2011 (JP) ..... 2011-227122

(51) Int. Cl.
*H01R 13/10* (2006.01)
*H01R 4/24* (2006.01)

(52) U.S. Cl.
CPC ..... *H01R 13/10* (2013.01); *H01R 4/2433* (2013.01); *H01R 4/2462* (2013.01); *H01R 4/2425* (2013.01)

(58) Field of Classification Search
CPC ..... H01R 4/245; H01R 4/2454; H01R 4/2458
USPC ..... 439/888–891, 395–406
See application file for complete search history.

(56) References Cited

U.S. PATENT DOCUMENTS 4,317,608 A 3/1982 Dechelette
4,826,449 A 5/1989 Debortoli et al.
(Continued)

FOREIGN PATENT DOCUMENTS

CA 1229670 A1 11/1987
DE 9101351 U1 4/1991
(Continued)

OTHER PUBLICATIONS

International Search Report for corresponding application PCT/JP2012/076499 filed Oct. 12, 2012; Mail date Jan. 8, 2013.
(Continued)

*Primary Examiner* — Chandrika Prasad
(74) *Attorney, Agent, or Firm* — Shinjyu Global IP

(57) ABSTRACT

A terminal, including an insertion groove for pressing a conductor thereinto disposed between a pair of conductive arm parts, where, when t represents a distance from a center of a contact part between the conductive arm part and the conductor to an end of the conductive arm part at a time of pressing-in of the conductor; h represents a width of the conductive arm part at the end thereof; and Y represents a width between an arbitrary position of the insertion groove and an outer edge of the conductive arm part, the following relation holds:

at a point of $(1/2)\times t$, $Y=(h/\sqrt{2})\times(0.8 \text{ to } 1.2)$.

22 Claims, 20 Drawing Sheets

(56) References Cited

U.S. PATENT DOCUMENTS

| | | | | |
|---|---|---|---|---|
| 5,088,934 | A | 2/1992 | Chow et al. | |
| 5,290,176 | A | 3/1994 | Soes et al. | |
| 5,685,733 | A * | 11/1997 | Janczak | 439/395 |
| 5,827,087 | A * | 10/1998 | Yamasaki | 439/395 |
| 6,290,531 | B1 * | 9/2001 | Onizuka et al. | 439/397 |
| 7,118,096 | B2 * | 10/2006 | Petrozziello | 256/32 |
| 8,105,105 | B2 * | 1/2012 | Taniguchi et al. | 439/395 |
| 2003/0045158 | A1 * | 3/2003 | Suzuki et al. | 439/404 |
| 2014/0213097 | A1 * | 7/2014 | Hemmi et al. | 439/406 |
| 2014/0315449 | A1 * | 10/2014 | Hemmi et al. | 439/816 |

FOREIGN PATENT DOCUMENTS

| | | | |
|---|---|---|---|
| EP | 0549158 | A2 | 6/1993 |
| JP | S53-156080 | U | 12/1978 |
| JP | S56-007364 | A | 1/1981 |
| JP | H01-154471 | A | 6/1989 |
| JP | 4179072 | A | 6/1992 |
| JP | 7226236 | A | 8/1995 |
| JP | 09232010 | A | 9/1997 |
| JP | 9312106 | A | 12/1997 |
| JP | 2000-077109 | A | 3/2000 |
| JP | 5251115 | A | 3/2003 |
| JP | 200377552 | A | 3/2003 |
| JP | 3098197 | U | 9/2003 |
| JP | 2005209540 | A | 8/2005 |
| JP | 2011096628 | A | 5/2011 |
| WO | 94/11922 | A1 | 5/1994 |

OTHER PUBLICATIONS

International Search Report for corresponding application PCT/JP2012/076497 filed Oct. 12, 2012; Mail date Jan. 8, 2013.

International Search Report for corresponding application PCT/JP2012/076498 filed Oct. 12, 2012; Mail date Jan. 15, 2013.

European Search Report from the corresponding European Patent Application No. 12839999.5 issued on May 4, 2015.

Office Action from the corresponding Japanese Patent Application No. 2013-538598 issued on Jun. 30, 2015.

* cited by examiner (A)

Prior Art (B)

TERMINAL HAVING AN INSERTION GROOVE FOR A CONDUCTOR AND A PAIR OF CONDUCTIVE ARM PARTS WITH A PLURALITY OF SLITS

CROSS REFERENCE TO RELATED APPLICATION

This application is the United States National Phase of International Patent Application Number PCT/JP2012/076497 filed on 12 Oct. 2012 which claims priority to Japanese Patent Application No. 2011-227122 filed on 14 Oct. 2011, all of which said applications are herein incorporated by reference in their entirety.

TECHNICAL FIELD

The present invention relates to a terminal where an electrical wire or the like is pressed into a U-shaped insertion groove, to be connected in relay connection of a censor or the like.

BACKGROUND ART

There have hitherto been provided a variety of terminals to be pressure-welded with an electrical wire, for use in a connector to connect the electrical wire.

Examples of such terminals include a terminal 103 in which an electrical wire 6 is pressed into an insertion part 102 provided with a U-shaped insertion groove 101 shown in FIG. 23(A). This terminal 103 was subjected to stress analysis of confirming a location of stress concentration and an amount of plastic deformation that occurs by a load by pressing the electrical wire 6 into the insertion part 102. It was found according to this stress analysis that stress concentrates on a region S.

FIG. 23(B) shows a result of the analysis of confirming the amount of plastic deformation, graphically representing a curve L indicative of the relation between the load applied to the insertion part 102 and the displacement amount thereby. Further, a straight line M is indicative of the relation between the applied load and the displacement amount with the insertion part 102 in an elastically deformed state. It is to be noted that the elastically deformed state refers to that the curve L is in a region of a straight line passing an origin, and this region is referred to as an elastic deformation region. The insertion part 102 of the terminal 103 is elastically deformed with the applied load up to a point P, but it is plastically deformed when the load further increases. For this reason, when the pressed-in electrical wire 6 is pulled out in a state where the applied load has reached a point Q, the insertion part 102 gets back along a straight line N parallel to the straight line M, to reach a point R. It was found from the above that this insertion part 102 is plastically deformed due to pressing-in of the electrical wire 6.

As a terminal having the above configuration, a pressure-welding connector terminal, which is connected with an electrical wire via an insertion part provided with a U-shaped slit similarly to the above, is described in Japanese Unexamined Patent Publication No. H9-312106.

However, in the terminal described in this publication, the U-shaped slit is just provided in a platy insertion part and the insertion part is thus apt to be plastically deformed in the case of pressing an electrical wire into the U-shaped slit, thus leading to a decrease in force of holding the electrical wire. There has thus been a problem of poor repairability at the time of reinserting and using the electrical wire.

Further, when the strength of the insertion part is enhanced for ensuring predetermined force of holding the electrical wire, spring force of the insertion part needs increasing, thus causing a problem of making the U-shaped slit difficult for pressing-in of the electrical wire.

BRIEF SUMMARY

The present invention has been made in view of the above conventional problems, and provides a terminal which does not require a large amount of applied load at the time of pressing-in of an electrical wire and reduces plastic deformation that occurs by the pressing-in of the electrical wire, thus allowing improvement in repairability at the time when the electrical wire is pulled out of an insertion groove and reinserted thereinto to be used.

The invention provides a terminal, including an insertion groove for pressing a conductor thereinto disposed between a pair of conductive arm parts, where, when t represents a distance from a center of a contact part between the conductive arm part and the conductor to an end of the conductive arm part at a time of pressing-in of the conductor; h represents a width of the conductive arm part at the end thereof; and Y represents a width between an arbitrary position of the insertion groove and an outer edge of the conductive arm part, the following relation holds: at a point of $(1/2)\times t$, $Y=(h/\sqrt{2})\times(0.8 \text{ to } 1.2$.

The invention further provides a terminal, including an insertion groove for pressing a conductor thereinto disposed between a pair of conductive arm parts, where, when X represents a distance from a center of a contact part between the conductive arm part and the conductor to an inside at a time of pressing-in of the conductor; Y represents a width between the insertion groove at a point of the distance X and an outer edge of the conductive arm part; and b represents a thickness of the conductive arm part, b is proportional to X in the case of Y being substantially constant.

BRIEF DESCRIPTION OF THE DRAWINGS

FIG. 2(A) is a front view before pressing of an electrical wire into an insertion part, FIG. 2(B) is a front view in a state where the electrical wire is pressed into an opening of the insertion part, and FIG. 2(C) is a front view in a state where the electrical wire is pressed into the insertion groove of the insertion part.

FIG. 9(A) is a front view showing a modified example where a circular hole is provided in the insertion part of FIG. 3(A), FIG. 9(B) is a front view showing a modified example where an arc-like hole is provided in the insertion part of FIG. 3(A), and FIG. 9(C) is a front view showing a modified example where a linear hole is provided in the insertion part of FIG. 3(A).

FIG. 10(A) is a front view showing a modified example where an arc-like notched part with an angle over 180° is provided at the end of the insertion groove of FIG. 3(A), and FIG. 10(B) is a partial enlarged view of force that is acted on the arc-like notched part of FIG. 10(A).

FIG. 11(A) is a front view showing a modified example where a triangular through hole is provided in the conductive arm part, and FIG. 11(B) is a perspective view of FIG. 11(A).

FIG. 12(A) is a front view showing a modified example where an inclined surface is provided in the conductive arm part of FIG. 11(A), and FIG. 12(B) is a perspective view of FIG. 12(A).

FIG. 13(A) is a front view showing a modified example where a long slit and a short slit are provided in the conductive arm part, and FIG. 13(B) is a perspective view of FIG. 13(A).

FIG. 14(A) is a front view showing a modified example where a U-shaped slit is provided in the conductive arm part, and FIG. 14(B) is a perspective view of FIG. 14(A).

FIG. 16(A) is a front view showing a modified example where a slit is provided in the conductive arm part of FIG. 14(A), and FIG. 16(B) is a perspective view of FIG. 16(A).

FIG. 17A is a front view showing a modified example where an arc-like notched part and a slit are provided in the conductive arm part of FIG. 11(A), and FIG. 17(B) is a perspective view of FIG. 17(A).

FIG. 18(A) is a perspective view showing a modified example where a thickness b of the conductive arm part is proportional to a distance X, and FIG. 18(B) is a front view of FIG. 18(A).

FIG. 19(A) is a front view showing a modified example where a pressing-in notch is formed in a contact part, and FIG. 19(B) is a partially enlarged view of FIG. 19(A).

FIG. 21(A) is a perspective view in a state where the insertion part of the present invention is applied to a card edge/plug-in connector for inserting an extension card of a PC thereinto, and FIG. 21(B) is a perspective view showing a modified example of FIG. 21(A).

FIG. 22(A) is a perspective view in a state where the insertion part of the present invention is applied to a connector connection terminal for connecting a flexible print substrate, and FIG. 22(B) is a perspective view showing a modified example of FIG. 22(A).

DETAILED DESCRIPTION

Figure 1:
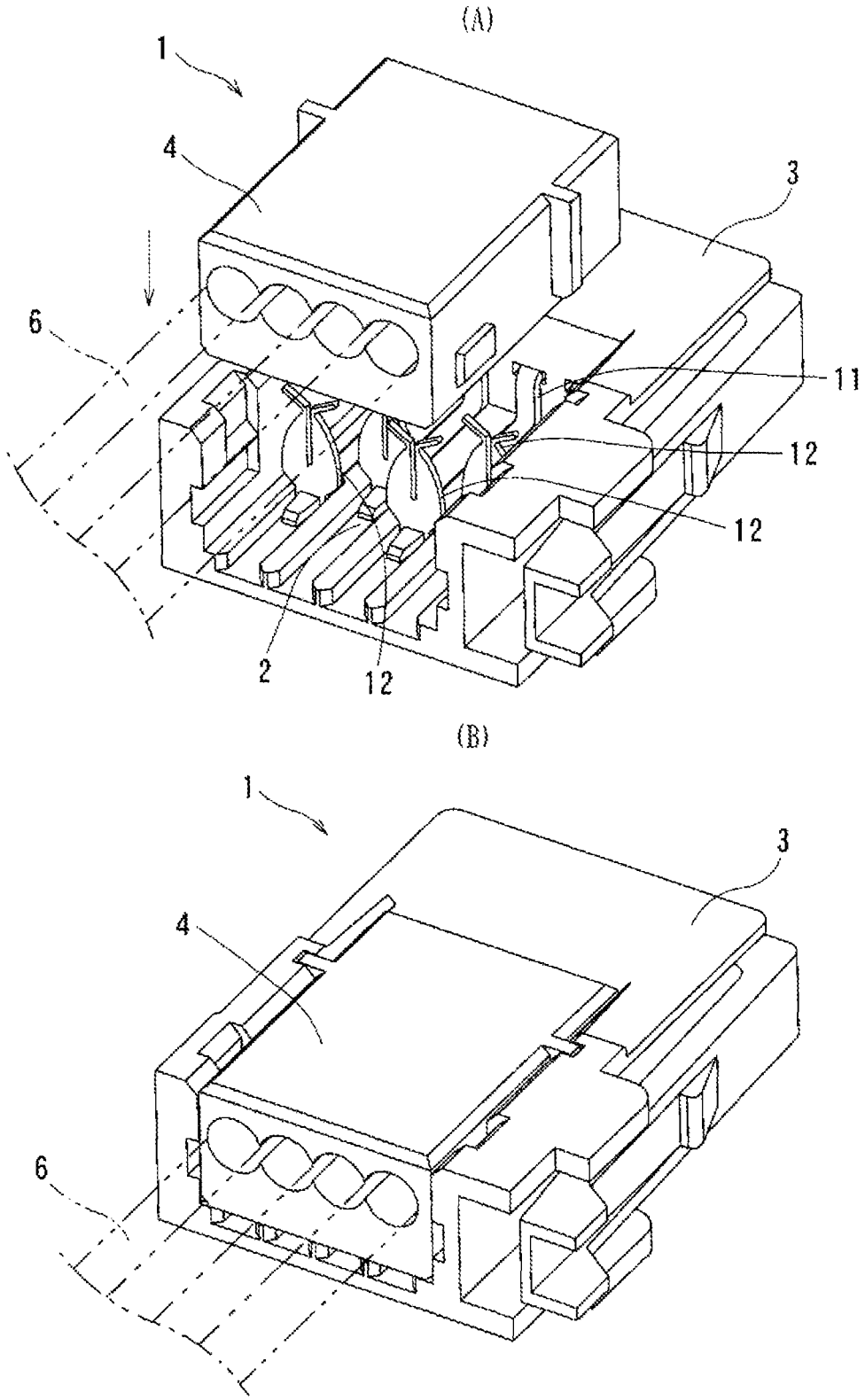
FIG. 1(A) is a perspective view showing a connector in a state where a housing mounted with a terminal according to the present invention and a header with an electrical wire integrated therein are separated from each other.
FIG. 1(B) is a perspective view showing a connector in a state where the housing and the header of FIG. 1(A) are fitted with each other.
Figure 2:
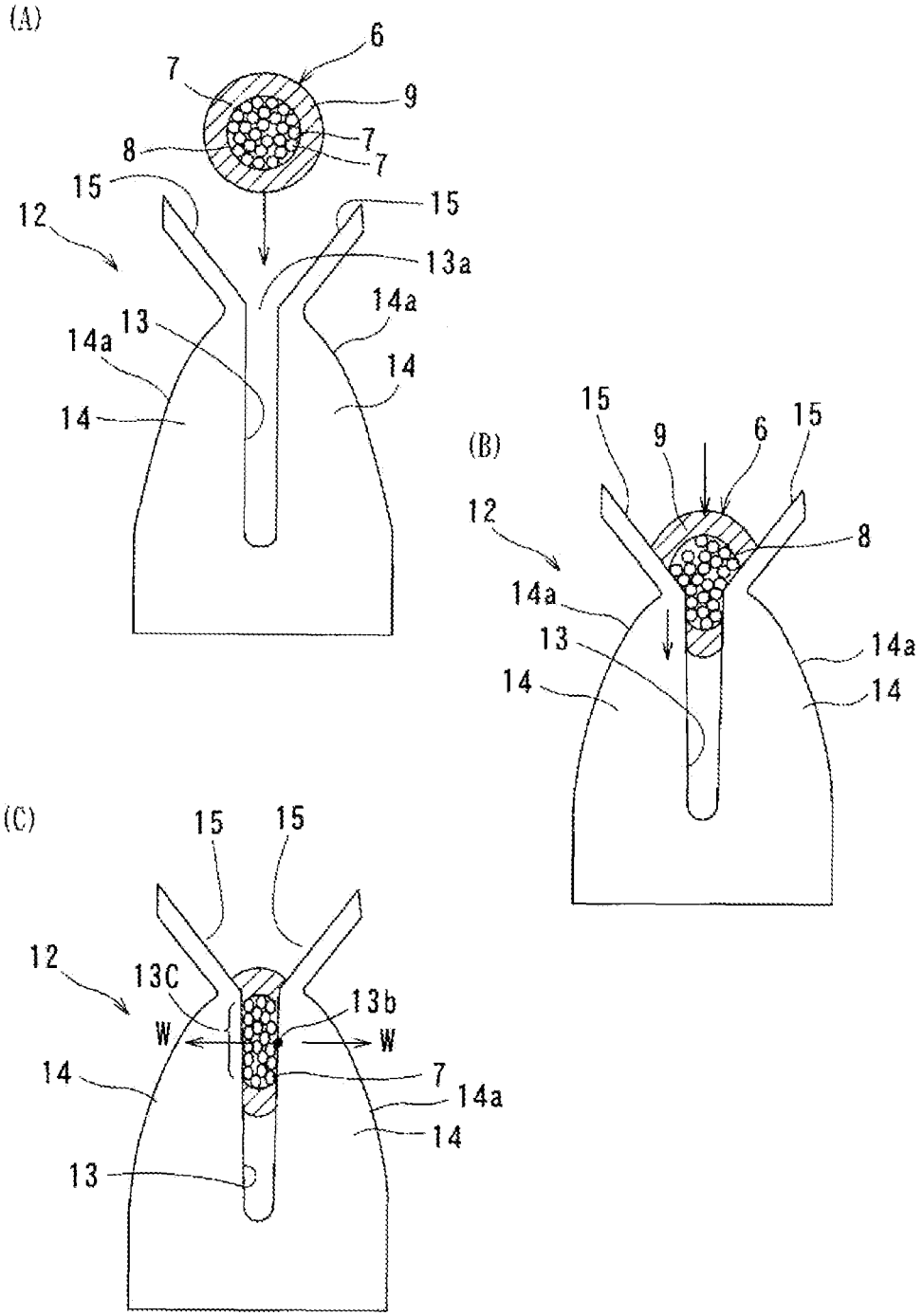
FIGS. 2(A) to 2(C) show a terminal according to First Embodiment.
Figure 3:
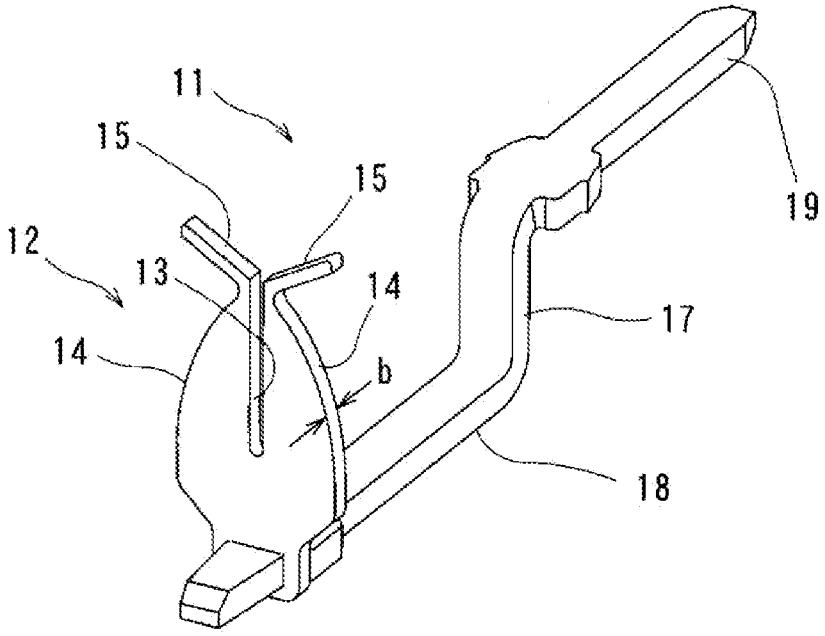
FIG. 3(A) is a perspective view of the terminal of FIG. 1.
FIG. 3(B) is a partially enlarged front view of the insertion part of FIG. 3(A).
Figure 3:
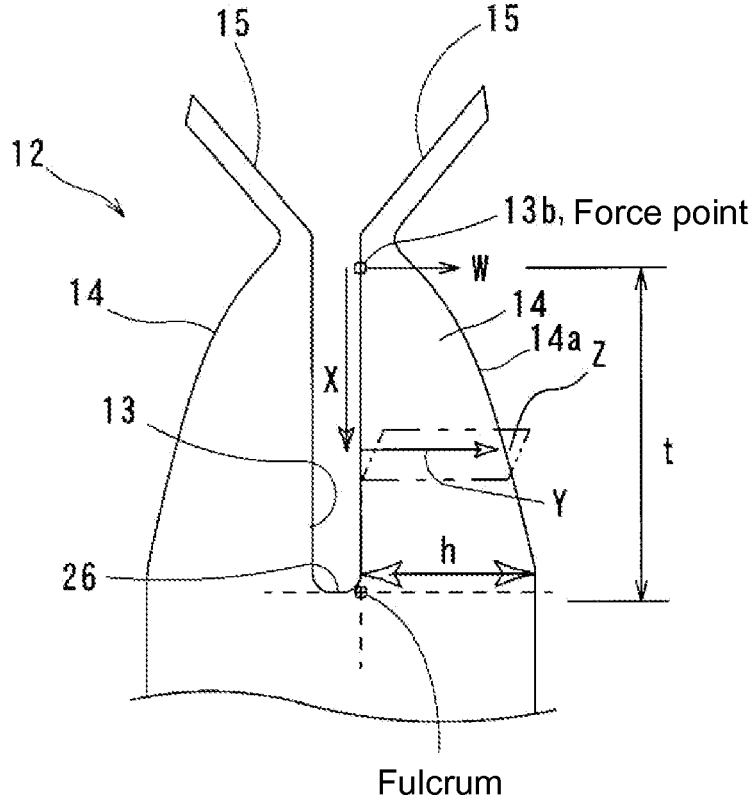
Figure 4:
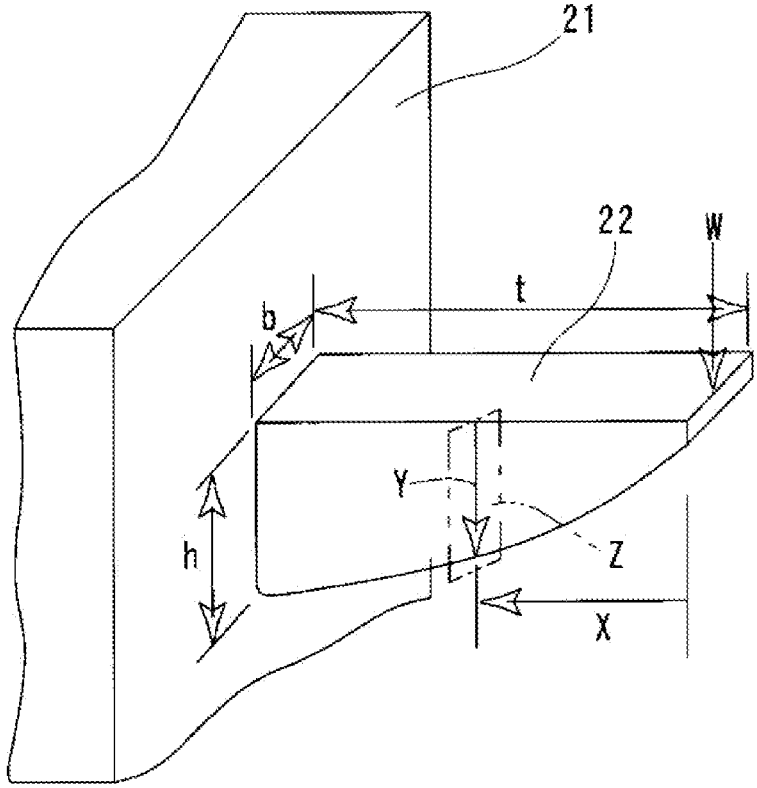
FIG. 4(A) is a perspective view of a beam cantilevered by a wall part.
FIG. 4(B) is a sectional view of the beam of FIG. 4(A).
Figure 4:
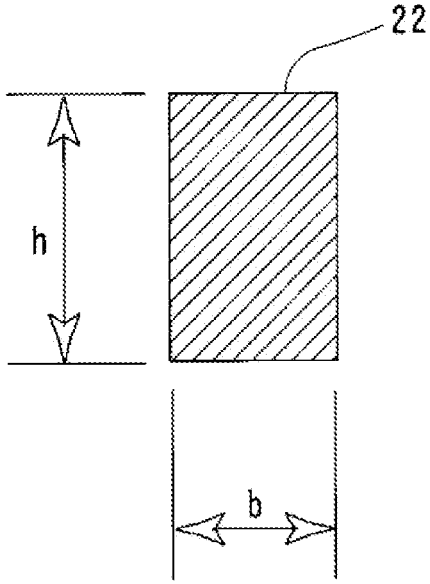

Hereinafter, embodiments of the terminal according to the present invention will be described in accordance with FIGS. 1 to 22.

In a First Embodiment, as shown in FIGS. 1(A) and 1(B), a connector 1 is made up of: a housing 3 which is mounted such that an insertion part 12 of a terminal 11 is located at an opening 2; and a header 4 with an electrical wire 6 integrated therein. Then, the header 4 is fitted into the opening 2 of the housing 3, to connect the insertion part 12 with the electrical wire 6.

Specifically, as shown in FIG. 2(A), the insertion part 12 of the terminal 11 is provided with: a U-shaped insertion groove 13 for pressing the electrical wire 6 thereinto from an opening 13*a* and holding it; a pair of conductive arm parts 14 which are symmetrically formed with this insertion groove 13 provided therebetween; and a peeling part 15 which removes a later-mentioned coated layer (coated material) 9 of the electrical wire (conductor) 6. The conductive arm part 14 is formed in the shape of a beam having uniform strength, with which stress is constant on any cross section at an outer edge 14*a*. Further, the conductive arm part 14 is configured of a metal material for spring, such as a copper alloy or a nickel alloy. The peeling part 15 extends from the upper end of the conductive arm part 14 so as to be open outward.

Next, an operation of pressing the electrical wire 6 into the insertion groove 13 will be described with reference to FIGS. 2(B) and 2(C).

The electrical wire 6 has a twisted line 8 bundling a plurality of single lines 7, and a coated layer 9 made up of a resin coating a periphery of this twisted line 8. Upon pressing-in of the electrical wire 6 from the upper portion of the insertion part 12, first, the coated layer 9 is removed by the peeling part 15 and the twisted line 8 is exposed. When the electrical wire 6 is further pressed downward in the insertion groove 13, the twisted line 8 is guided downward from the opening 13*a* while slightly expanding the conductive arm part 14 outward (see FIG. 2(B)), and by reaction force thereof, the single line 7 begins to be deformed. Then, the twisted line 8 pressed into the insertion groove 13 is pressed with the single lines 7 in the state of being densely provided within the insertion groove 13 (see FIG. 2(C)). At this time, the twisted line 8 expands outward from a center 13*b* of a contact part 13*c* with the conductive arm part 14 by a load W, while each of the single lines 7 is plastically deformed into a flat shape by reaction force from the conductive arm part 14 and comes into contact with the conductive arm part 14 to be electrically conducted therewith.

As shown in FIG. 3(A), the terminal 11 provided with the insertion part 12 according to the First Embodiment has: a conductive part 18 formed with a step 17 at the center; the insertion part 12 which is fitted to one end of this conductive part 18 and erected in a vertical direction; and a plug part 19 which is formed at the other end of the conductive part 18 and fitted with an external contact. It is to be noted that in the present embodiment, although the insertion part 12 as a separate body is fitted to the end of the conductive part 18, the insertion part 12 and the conductive part 18 may be provided in a unified manner (see FIG. 6). Further, as shown in FIGS. 7(A) and 7(B), a configuration may be formed where a rectangular notch 24 is provided at the bottom of the insertion part 12, and this notch 24 is engaged into a concave-shaped projection 25 formed on the upper surface of the conductive part 18, to connect the insertion part 12 to the conductive part 18.

The insertion part 12 is a platy body having a uniform thickness b. As shown in FIG. 3(B), when the center 13*b* of the contact part 13*c* with the electrical wire 6 at the time of pressing-in of the electrical wire 6 is regarded as a force point, the conductive arm part 14 is formed such that a section modulus Z at a point reached by moving just a distance X from this force point toward the inside of the insertion groove 13 is proportional to the distance X.

Hereinafter, it is designed in FIG. 3(B) that the conductive arm part 14 on the right side of the insertion groove 13 becomes a beam 22 having uniform strength cantilevered by a wall part 21 shown in FIG. 4(A). That is, X represents a distance from the force point of the conductive arm part 14 to the inside of the insertion groove 13, Y represents a width of the conductive arm part 14 at the point reached by moving just the distance X from the force point within the insertion groove 13, b represents a thickness of the conductive arm part 14, and h represents the maximum width at a fulcrum provided at an end 26 of the conductive arm part 14.

Herein, as shown in FIG. 4(B), a section modulus Z of the beam 22 with a cross section having the thickness b and the maximum width h is expressed by the following formula:

$$Z=(b\times h^2)/6$$

Next, balance of force in the cantilevered beam 22 shown in FIG. 4(A) will be described.

The section modulus Z at the point of the distance X is expressed by the following formula by using the width Y and the thickness b at this point:

$$Z=(b\times Y^2)/6 \qquad \text{Formula (1)}$$

The relation between a bending moment M and stress at the point of the distance X is expressed by the following formula:

$$M=\sigma\times Z \qquad \text{Formula (2)}$$

Further, the bending moment M at the point of the distance X is expressed by the following formula:

$$M=W\times X \qquad \text{Formula (3)}$$

According to Formulas (2), (3), the following formula can be expressed:

$$Z=(W/\sigma)\times X \qquad \text{Formula (4)}$$

At that time, Z may be made proportional to X in order to make σ constant.

Further, Formula (1) may be substituted for Z of Formula (4), to make $Y^2$ proportional to X.

At this time, when boundary conditions for the end 26: X=t and Y=h, are substituted, the constant stress a can be expressed by the following formula:

$$\sigma=(6\times W\times t)/(b\times h^2)$$

From the above, the width Y of the conductive arm part 14 is decided such that the section modulus Z is proportional to the distance X, namely the relation for making the width $Y^2$ proportional to the distance X holds. Accordingly, even when the load W is applied at the time of pressing the electrical wire 6 into the insertion groove 13, the stress a generated throughout the conductive arm part 14 is constant, and hence the stress a is not biased to a specific place of the conductive arm part 14. Hence it is possible to reduce plastic deformation and plastic distortion that occur in the conductive arm part 14, while reducing a decrease in holding force due to exhaustion even when the electrical wire is once pulled out of the insertion groove 13 and reinserted thereinto, so as to improve the repairability. Further, the shape of the conductive arm part 14 is simplified, thereby facilitating production of the terminal 11 and allowing reduction in production cost thereof.

Figure 5:
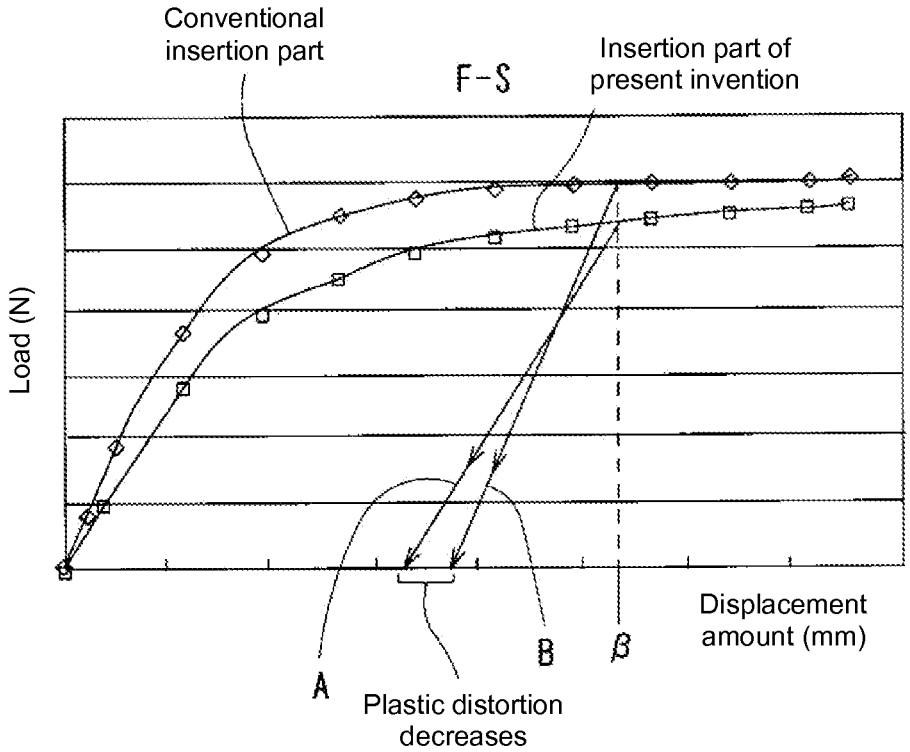
FIG. 5 is a graph showing the relation between each of loads, respectively applied to the insertion part of the present invention and a conventional insertion part, and a displacement amount thereby.
Figure 6:
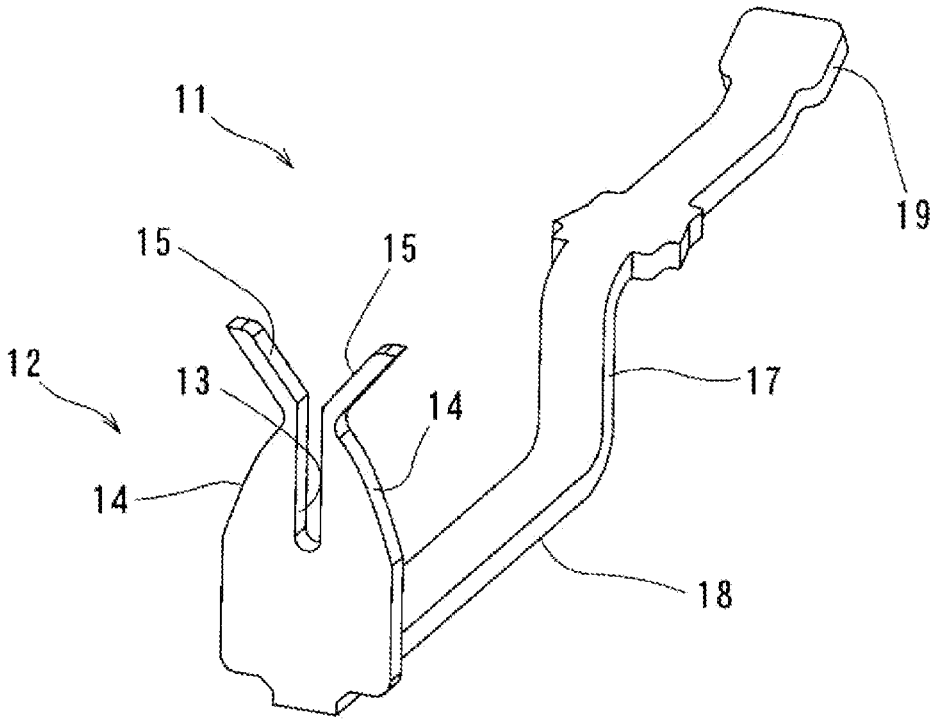
FIG. 6 is a perspective view showing a modified example of the terminal of FIG. 3(A).
Figure 7:
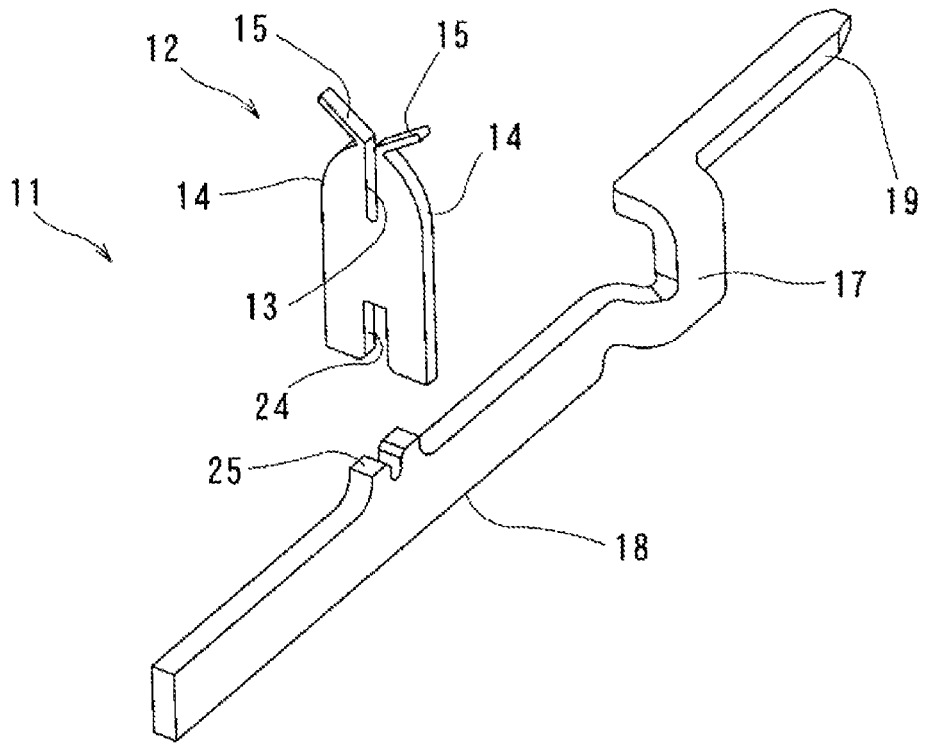
FIG. 7(A) is a perspective view showing a modified example of the terminal in a state where the insertion part is separated from a conductive part.
FIG. 7(B) is a perspective view showing a state where the insertion part is joined with the conductive part in FIG. 7(A).
Figure 7:
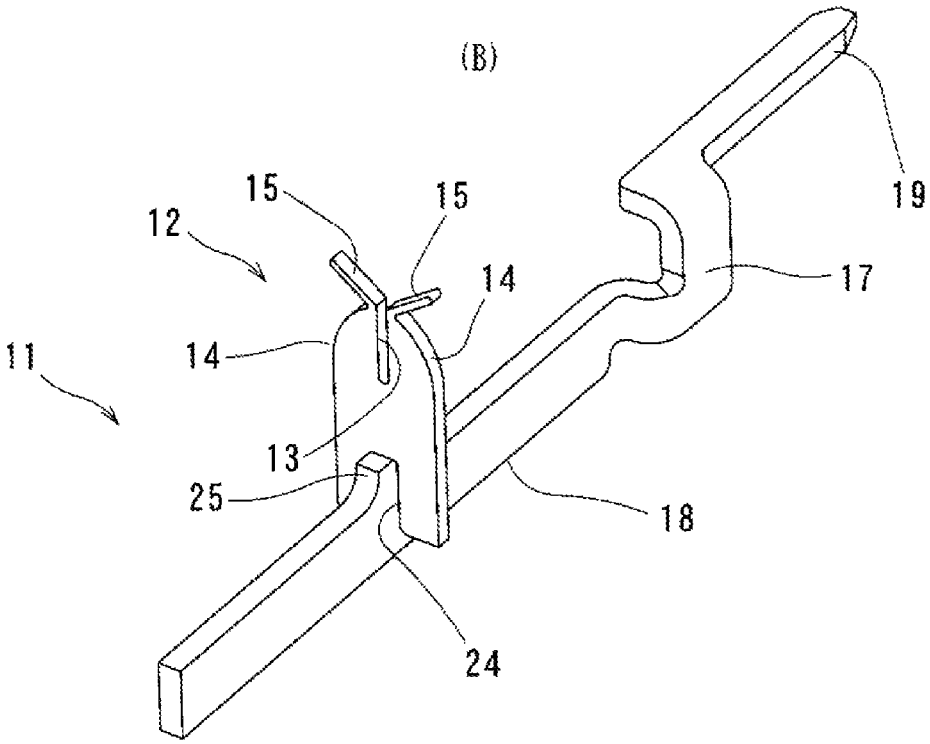
Figure 8:
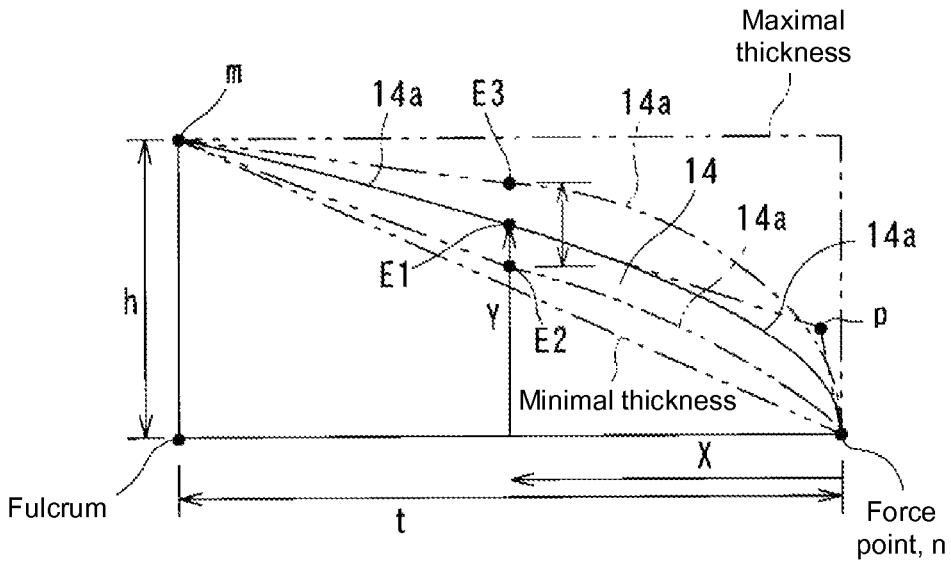
FIG. 8(A) is a diagram showing a modified example of an outer edge shape of a conductive arm part.
FIG. 8(B) is a graph showing the relation between each of loads, respectively applied to insertion parts having a variety of outer edge shapes, and a displacement amount thereby.
Figure 8:
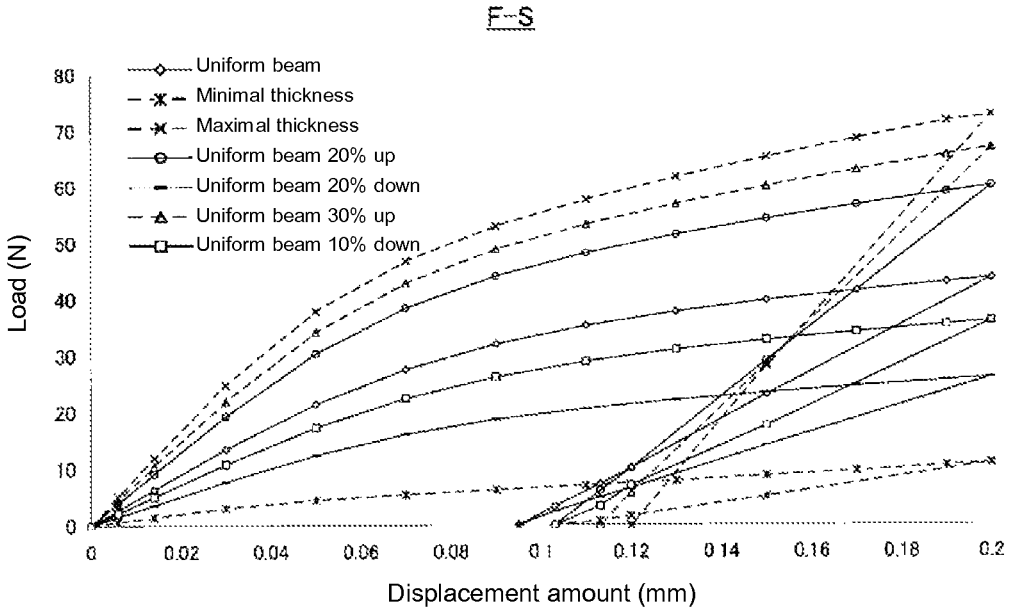
Figure 9:
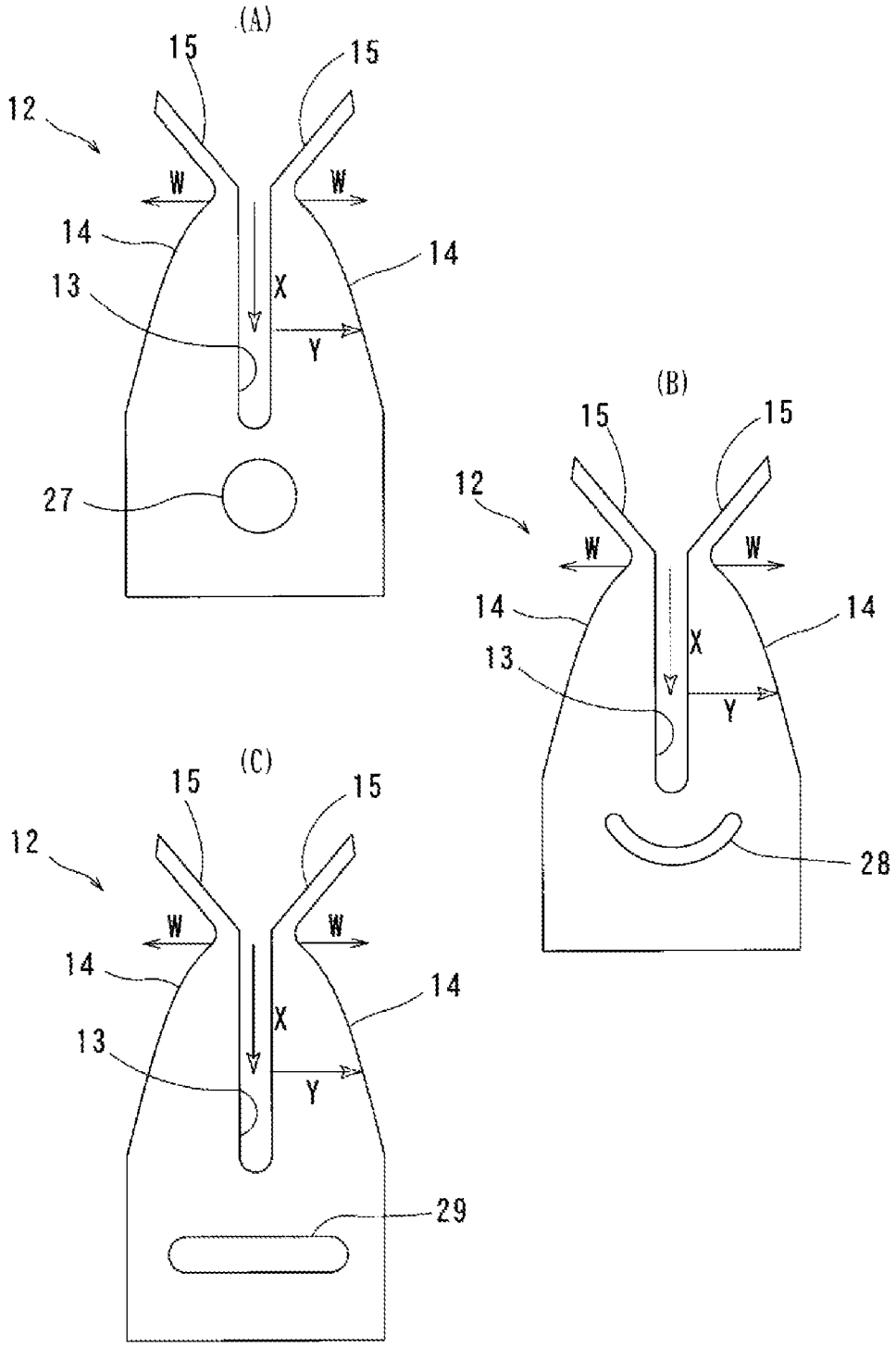
FIGS. 9(A) to 9(C) show a terminal according to a modified example of First Embodiment.
Figure 10:
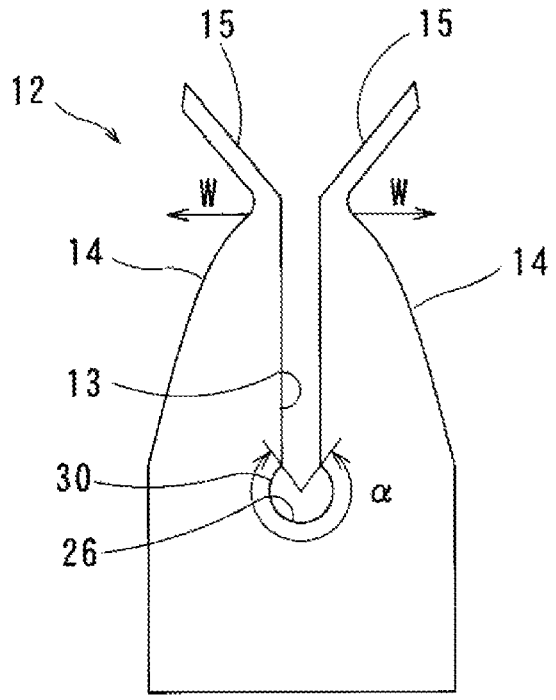
FIGS. 10(A) and 10(B) show a terminal according to a further modified example of First Embodiment.
Figure 10:
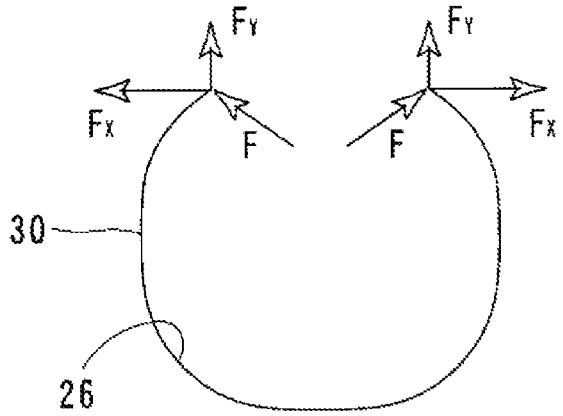
Figure 11:
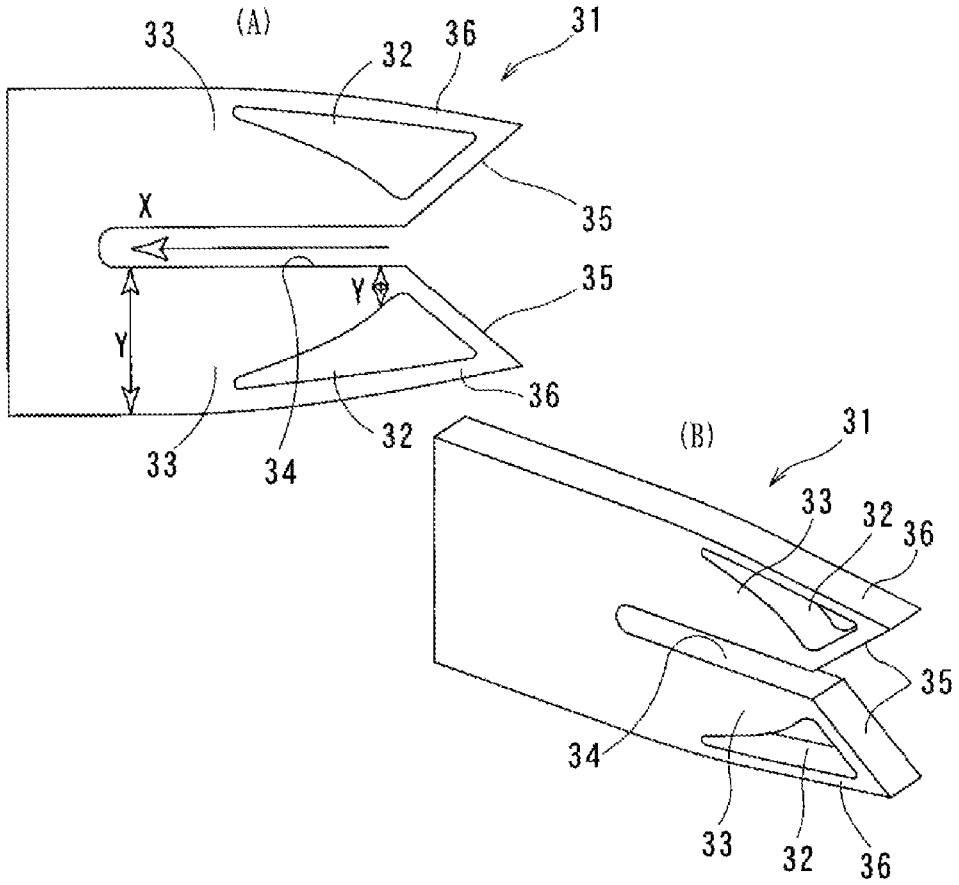
FIGS. 11(A) and 11(B) show a terminal according to Second Embodiment.
Figure 12:
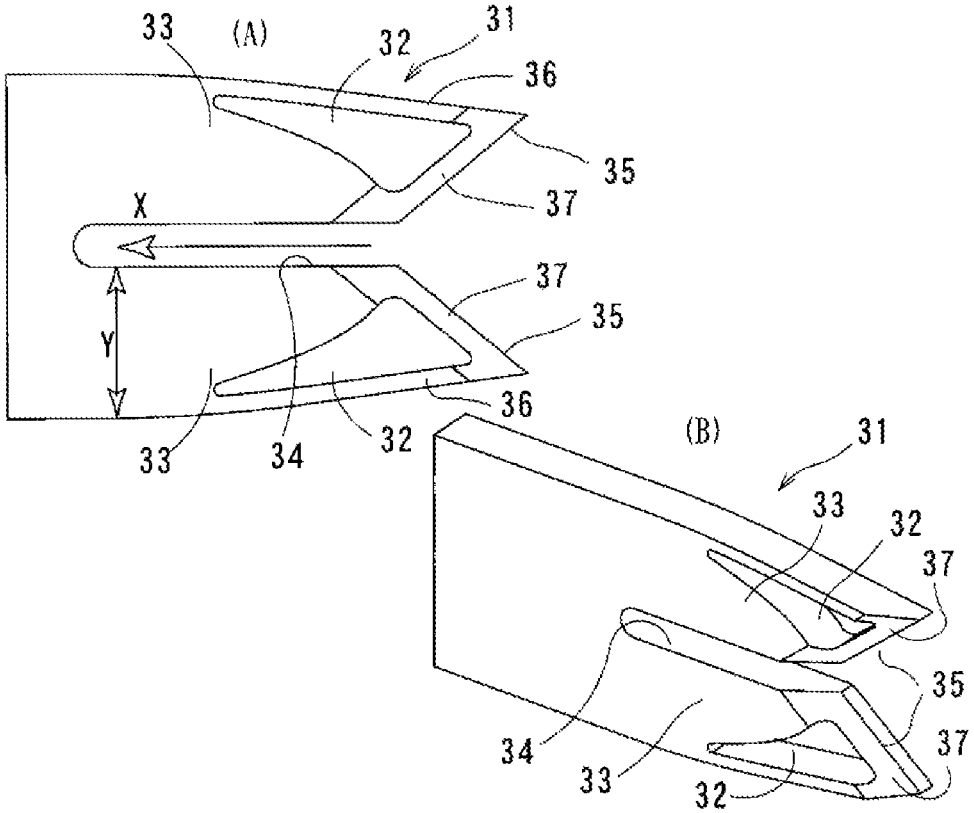
FIGS. 12(A) and 12(B) show a terminal according to a modified example of Second Embodiment.
Figure 13:
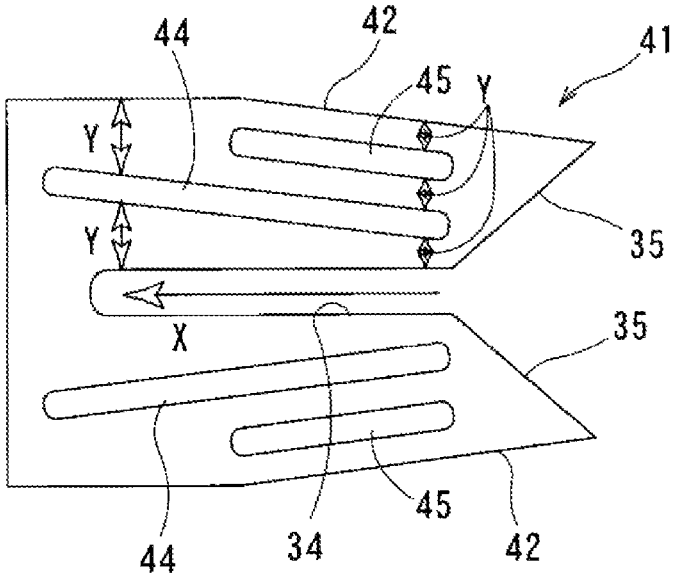
FIGS. 13(A) and 13(B) show a terminal according to Third Embodiment.
Figure 13:
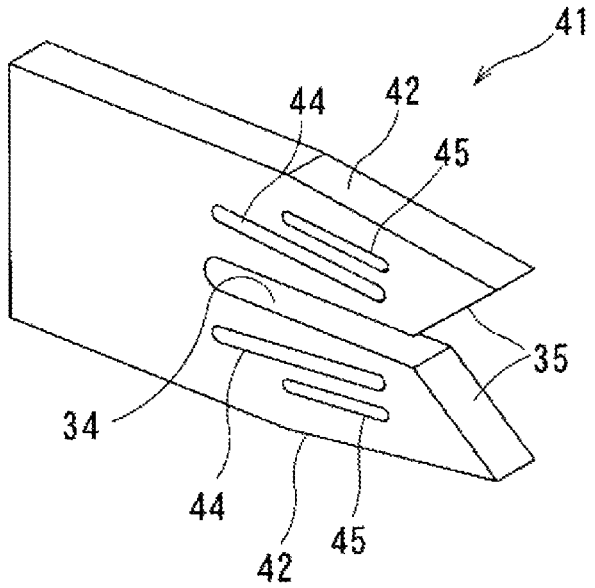
Figure 14:
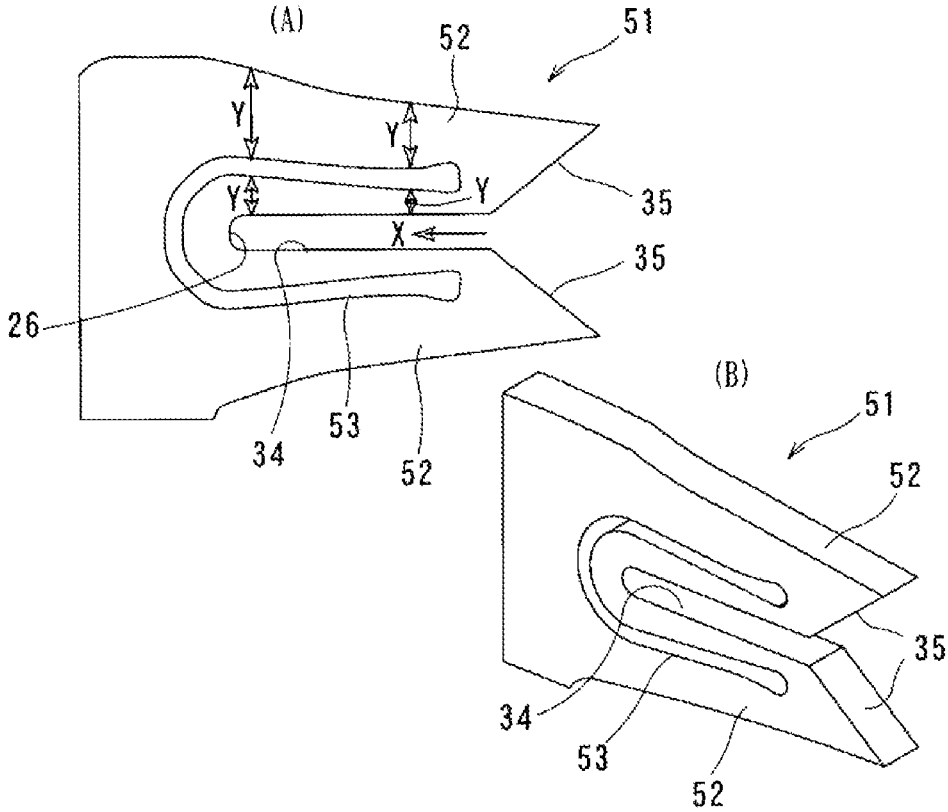
FIGS. 14(A) and 14(B) show a terminal according to Fourth Embodiment.
Figure 23:
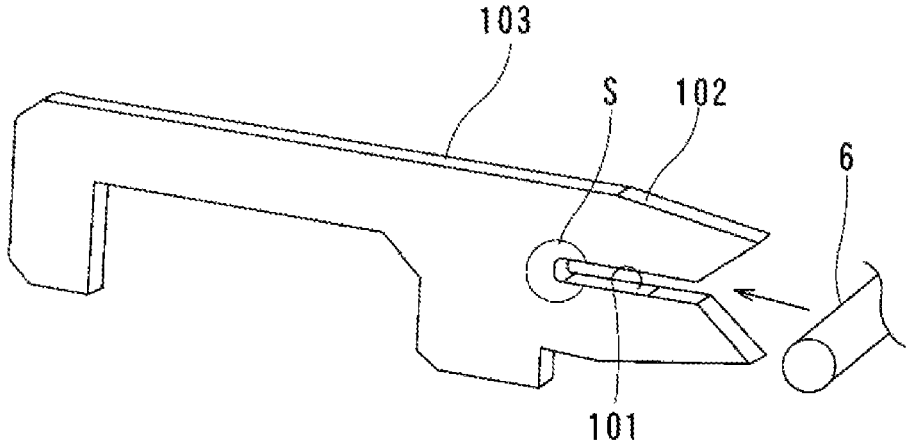
Fig. 23 Prior Art
FIG. 23(A) is a perspective view of a conventional terminal.
FIG. 23(B) is a graph showing the relation between a load applied to an insertion part of FIG. 23(A) and a displacement amount thereby.
Figure 23:
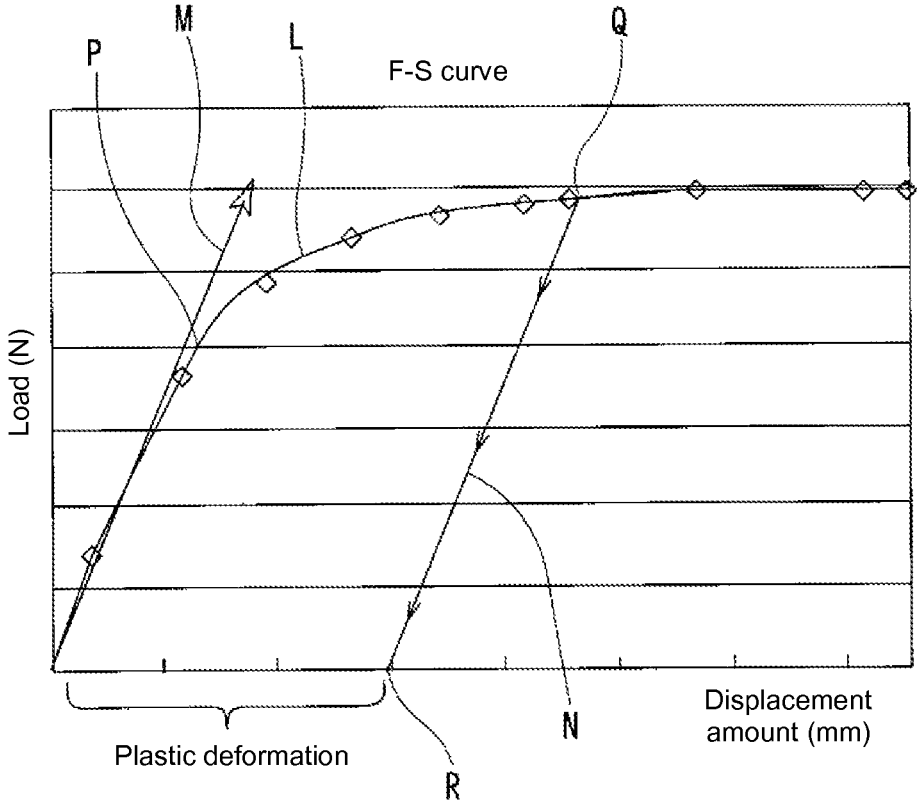
Fig. 23 Prior Art

The present inventors conducted analysis of applying a load to each of the insertion part 12 according to the present invention and the conventional insertion part shown in FIG. 23(A). FIG. 5 shows analysis results. FIG. 5 is a graph showing the relation between each of loads, respectively applied to the insertion part 12 of the present invention and the conventional insertion part, and a displacement amount thereby.

According to the present analysis results, the inclination of the elastic deformation region is small in the insertion part 12 of the present invention as compared with the conventional insertion part. Namely, it is found that the insertion part 12 of the present invention is apt to be elastically deformed and is not apt to be plastically deformed. Therefore, when the electrical wire 6 is pulled out in a state where the displacement of each insertion part has reached 13, the insertion part 12 of the present invention returns to the original shape along a straight line A.

On the other hand, the conventional insertion part returns to the original shape along a straight line B. Since the insertion part 12 of the present invention is apt to be elastically deformed and is reduced in plastic distortion, it was confirmed that, even when the electrical wire 6 is once pulled out of the insertion groove 13 and reinserted thereinto, the holding force does not decrease and the repairability is high.

Further, as apparent from FIG. 5, it is found that, when the insertion part 12 of the present invention and the conventional insertion part are to be displaced in the same amount, the insertion part 12 of the present invention is displaced by a small load as compared with the conventional insertion part. It was thus found that the load required at the time of pressing the electrical wire 6 into the insertion groove 13 becomes small, and the electrical wire 6 becomes easy for pressing-in.

As described above, in order to make constant the stress to be applied to each cross section of the conductive arm part 14, the width Y of the conductive arm part 14 was decided so as to make the width $Y^2$ proportional to the distance X. However, the beam 22 having uniform strength is not restrictive, and even one with a shape approximate to that of the beam 22 having uniform strength can efficiently disperse stress. At this time, the following relation holds:

$$\text{when } X=(1/2)\times t,$$

$$\text{at a point of } X,\ Y=(h/\sqrt{2})\times(0.8 \text{ to } 1.2) \qquad \text{Formula (5)}$$

FIG. 8(A) shows a schematic view of the one-side conductive arm part 14. A variable σ represents "0.8 to 1.2" in above Formula (5). When $\alpha=1$, namely when $Y=h/\sqrt{2}$ holds with X at the point of $(1/2)\times t$, an outer edge 14*a* of the conductive arm part 14 passes a point E1. At this time, the conductive arm part 14 has the shape of the beam 22 having uniform strength. When $\alpha=0.8$, namely when $Y=(h/\sqrt{2})\times 0.8$ holds, the outer edge 14*a* of the conductive arm part 14 passes a point E2. When $\alpha=1.2$, namely when $Y=(h/\sqrt{2})\times 1.2$ holds, the outer edge 14*a* of the conductive arm part 14 passes a point E3. Accordingly, when above Formula (5) holds, the outer edge 14*a* with X at the point of $(1/2)\times t$ is located between E2 and E3.

The present inventors conducted analysis of applying a load to each of the conductive arm parts 14 formed by applying a variety of values to $\alpha$. FIG. 8(B) shows analysis results. FIG. 8(B) shows the relation between each of loads, respectively applied to a variety of conductive arm parts 14, and a displacement amount thereby. It is to be noted that "Uniform beam" in the figure refers to $\alpha=1$. "Minimal thickness" refers to a case where the outer edge 14*a* is formed of a straight line connecting points m and n as shown in FIG. 8(A) and the conductive arm part 14 has a triangular shape. Further, "Maximal thickness" refers to a case where the conductive arm part 14 has a rectangular shape with the points m and n being vertexes. "Uniform beam 20% up" refers to $\alpha=1.2$. "Uniform beam 20% down" refers to $\alpha=0.8$. "Uniform beam 30% up" refers to $\alpha=1.3$. "Uniform beam 10% up" refers to $\alpha=1.1$.

According to the present analysis results, the displacement amount of the conductive arm part 14, applied with 0.8 to 1.2 as the value of a, namely plastic deformation, becomes small. On the other hand, it is found that, even when the value of a becomes smaller than 0.8 or the value of a becomes larger than 1.2, the displacement amount, namely the plastic deformation, becomes large. When $\alpha$ becomes smaller than 0.8, at the time of pressing the electrical wire 6 into the insertion groove 13, stress concentrates on the tip of the conductive arm part 14 and the tip is plastically deformed. When $\alpha$ becomes larger than 1.2, at the time of pressing the electrical wire 6 into the insertion groove 13, stress concentrates on the end 26 of the conductive arm part 14 and the end 26 is plastically deformed. From the above, $\alpha$ is preferably from 0.8 to 1.2.

So long as the outer edge 14*a* of the conductive arm part 14 passes between E2 and E3 at the point of $X=(1/2)\times t$, the shape is not particularly restricted. For example, points m and E1, as well points E1 and n, may be connected by a straight line, or may be connected by a curve. Further, there may be adopted a configuration where an arbitrary point p (see FIG. 8(A)) may be provided between the points E1 and n, and the points E1 and p and the points p and n are respectively connected by straight lines.

Naturally, the insertion part of the present invention is not restricted to the above embodiment, and a variety of shapes can be adopted so long as the section modulus Z is proportional to the distance X.

A modified example of First Embodiment is a case where a discontinuous circular hole 27 is provided on the deeper side than the insertion groove 13 as shown in FIG. 9(A). Similarly, as shown in FIG. 9(B), an arc-like hole 28, which is curved downward and whose end is formed in a semicircular shape, may be provided. Further, as shown in FIG. 9(C), a linear hole 29 whose end is formed in a semicircular shape may be provided. Providing a slit on the deeper side than the insertion groove 13 as above further facilitates elastic deformation of the conductive arm part 14, and can reduce the plastic deformation of the insertion part 12 at the time of the load W being applied.

Another modified example is a case where an arc-like notched part 30 with an angle over 180° is provided at the end 26 of the insertion groove 13, as shown in FIG. 10(A). A diameter of this arc-like notched part 30 is larger than the width of the insertion groove 13. With this configuration, as shown in FIG. 10(B), by application of the load W, force of a vertical component FY and vertical force generated by the load W cancel each other, out of a horizontal component FX and FY of force F generated at each end of the arc-like notched part 30, and hence it is possible to disperse stress, so as to alleviate stress concentration.

Other components are the same as the insertion part 12 according to First Embodiment, and hence the same numeral is provided to the same portion and a description thereof is omitted.

A second Embodiment is a case where a reinforcing part 36 is provided between a conductive arm part 33 as the beam having uniform strength and the end of a peeling part 35 in an insertion part 31, as shown in FIGS. 11(A) and 11(B). In this insertion part 31, the outer edge of the conductive arm part 33, the peeling part 35 and the reinforcing part 36 form a substantially triangular through hole 32. Supporting the end of the peeling part 35 by means of the reinforcing part 36 can lead to improvement in supporting strength of the peeling part 35.

Further, a modified example of Second Embodiment is a case where an inclined surface 37 which is inclined parallel to the end surface of the peeling part 35 is formed on the peeling part 35 of the insertion part 31, as shown in FIGS. 12(A) and 12(B). This is advantageous in that the coated layer 9 of the electrical wire 6 can be removed with ease and the electrical wire 6 can be pressed into an insertion groove 34 by a smaller load.

Third Embodiment is a case where a long slit 44 is provided in the vicinity of the insertion groove 34 of a conductive arm part 42 and a short slit 45 is provided on the outer side of this slit 44 along the outer shape of the conductive arm part 42, as shown in FIGS. 13(A) and 13(B). Therefore, a sectional area of the conductive arm part 42 can be changed while the thickness thereof remains uniform, and the section modulus Z is proportional to the distance X, whereby it is possible to obtain a similar effect to the above. Further, the slits 44, 45 are linearly provided, thereby facilitating production and allowing reduction in production cost. It is to be noted that the number of slits is not restricted to two, but it may be plural being three or larger, and in this case, a similar effect can be obtained by providing the longest slit 44 in the vicinity of the insertion groove 34 and disposing the plurality of slits so as to gradually have smaller lengths as being more distant from the insertion groove 34.

A fourth Embodiment is a case where a U-shaped slit (first slit) 53, which extends along the insertion groove 34 and surrounds the end 26 of the insertion groove 34, is provided in a conductive arm part 52 of an insertion part 51, as shown in FIGS. 14(A) and 14(B). Further, an outer shape of this conductive arm part 52 is curved such that the width Y orthogonal to the insertion groove 34 increases in accordance with the distance X. Hence it is possible to reduce plastic deformation of the insertion part 51 at the time of the load W being applied, while elastically deforming the conductive arm part 52, so as to prevent stress concentration at the end 26 of the insertion groove 34.

Figure 15:
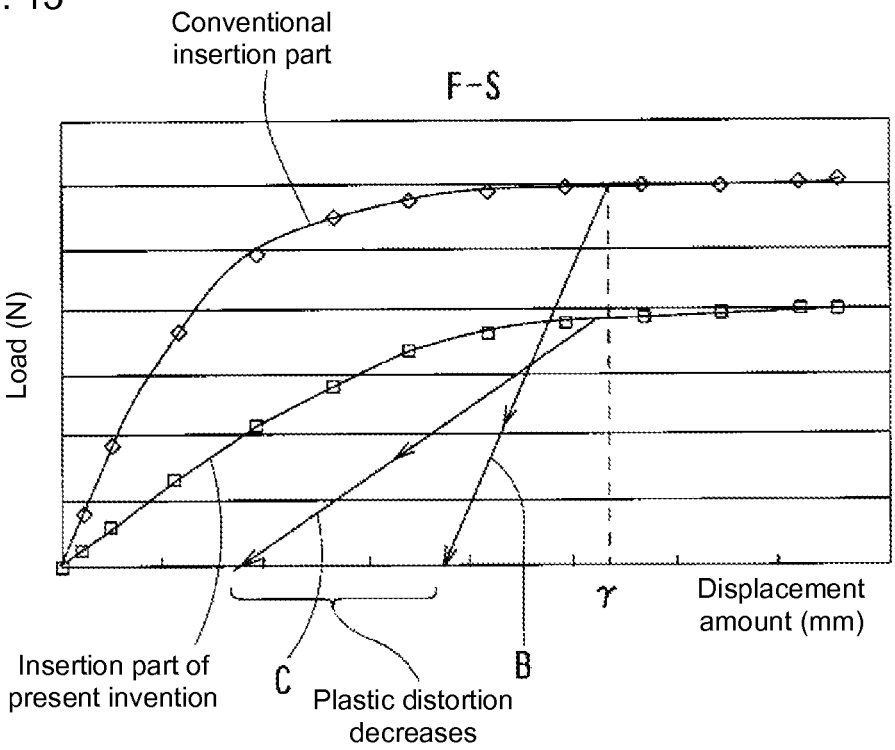
FIG. 15 is a graph showing the relation between each of loads, respectively applied to the insertion part of FIGS. 14(A) and 14(B) and a conventional insertion part, and displacement amount thereby.
Figure 16:
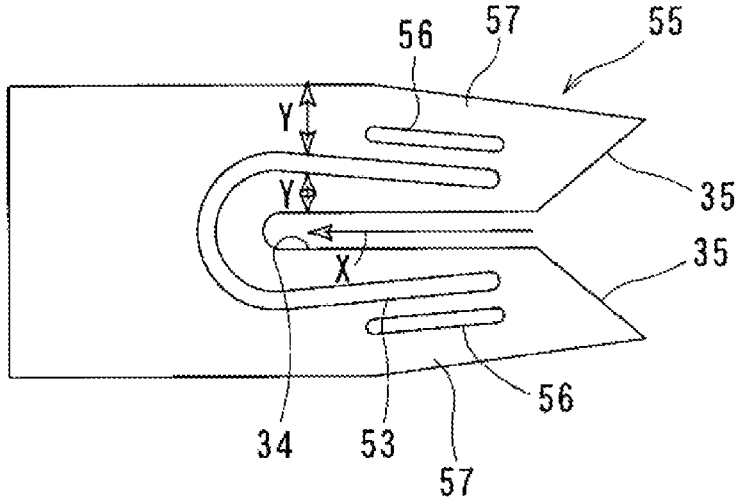
FIGS. 16(A) and 16(B) show a terminal according to a modified example of the Fourth Embodiment.
Figure 16:
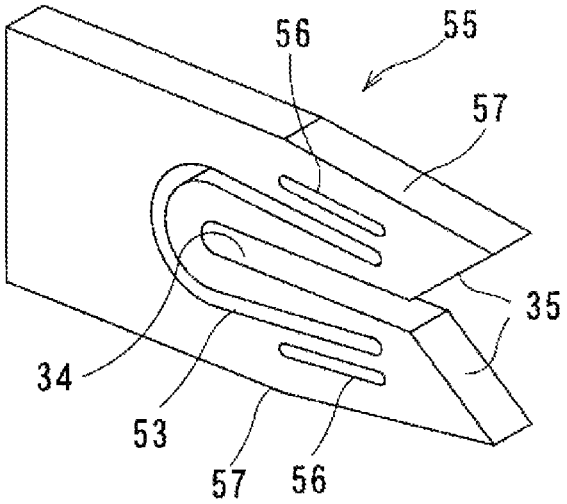
Figure 17:
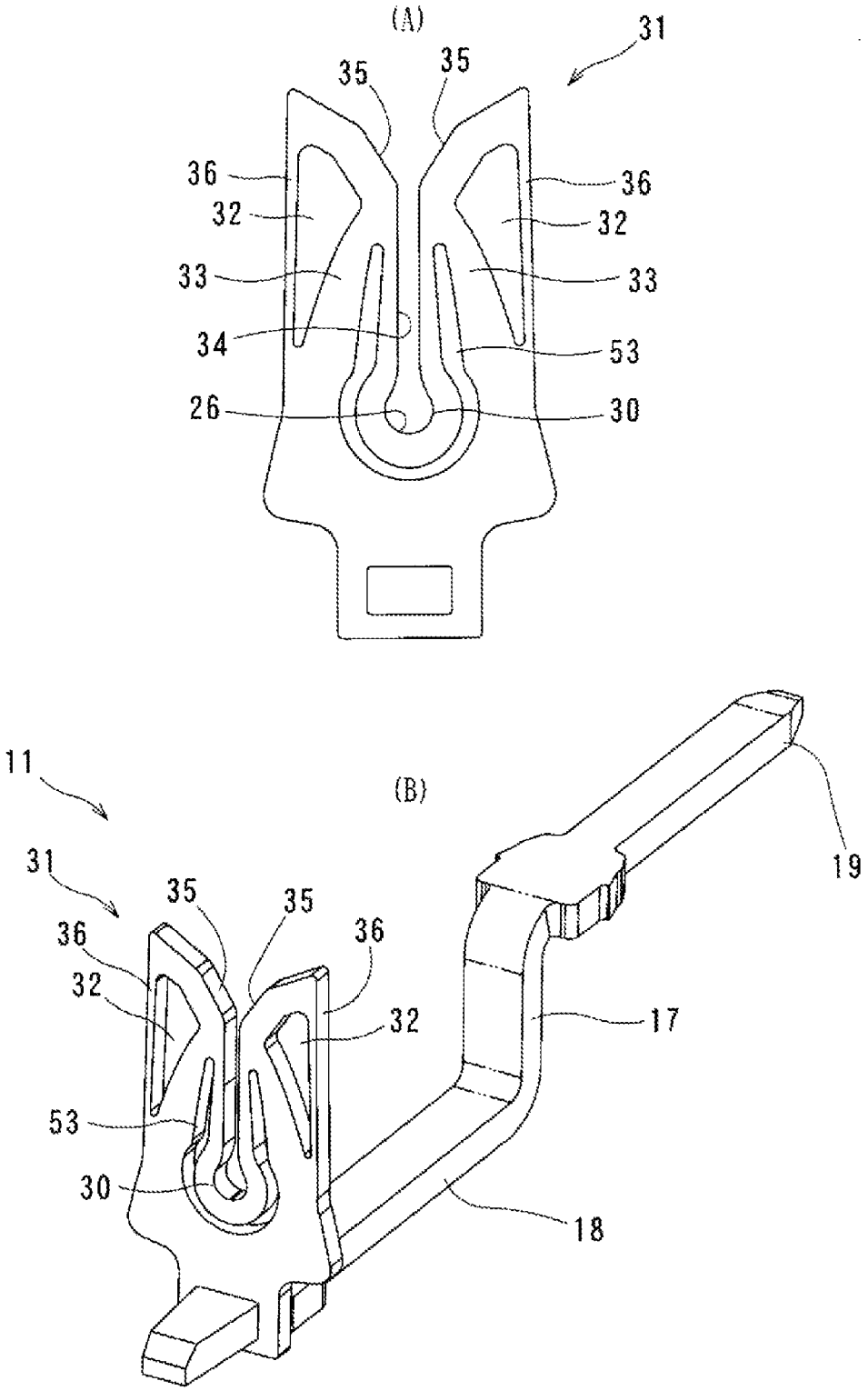
FIGS. 17(A) and 17(B) show a terminal according to Fifth Embodiment.
Figure 18:
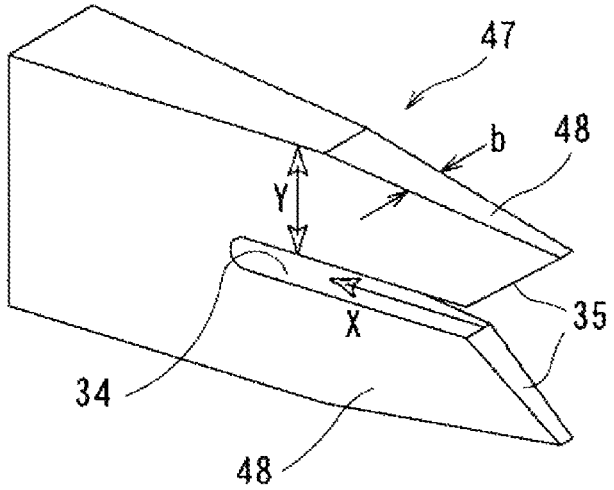
FIGS. 18(A) and 18(B) show a terminal according to Sixth Embodiment.
Figure 18:
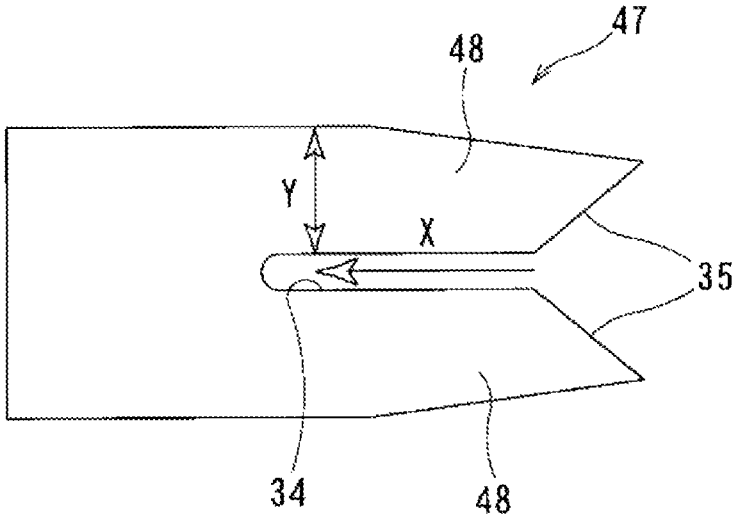
Figure 19:
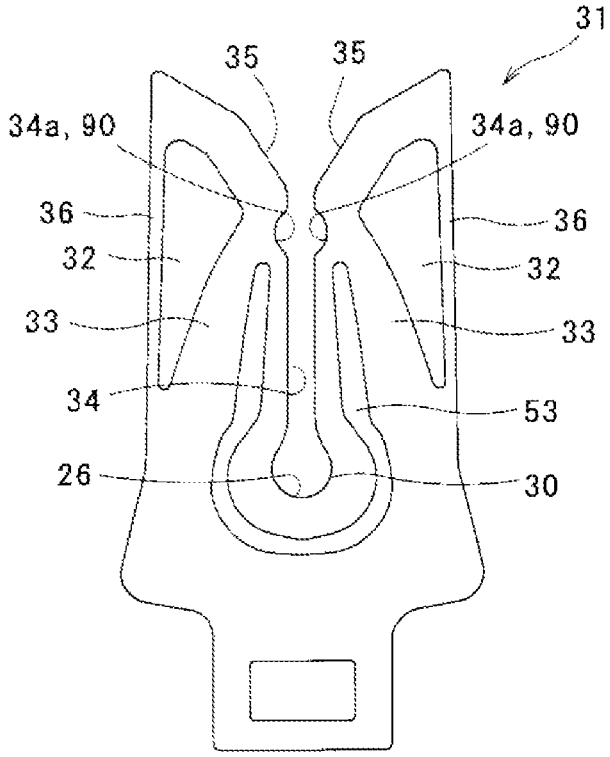
FIGS. 19(A) and 19(B) show a terminal according to Seventh Embodiment.
Figure 19:
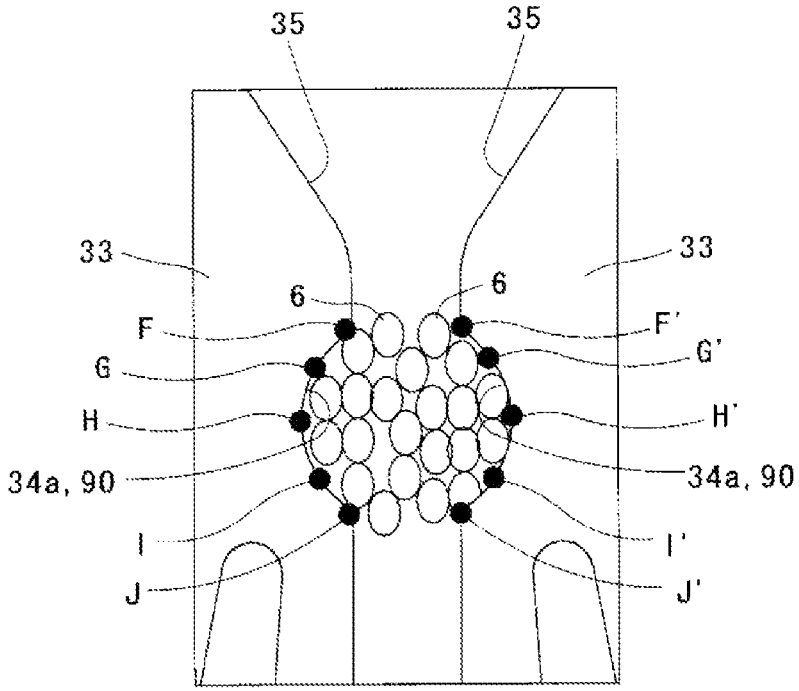

FIG. 15 shows results of analysis of applying a load to each of the insertion part 51 having the conductive arm part 52 and the conventional insertion part shown in FIG. 23(A). According to this, the inclination of the elastic deformation region is significantly small in the insertion part 51 of the present embodiment as compared with the conventional insertion part. Therefore, when the electrical wire 6 is pulled out in a state where the displacement of each insertion part has reached γ, the insertion part 51 of the present embodiment returns to the original shape along a straight line C.

On the other hand, in the conventional insertion part, it returns to the original shape along the straight line B. Since the insertion part 51 of the present embodiment is apt to be elastically deformed and is significantly reduced in plastic distortion, it was confirmed that, even when the electrical wire 6 is once pulled out of the insertion groove 34 and reinserted thereinto, the holding force does not decrease and the repairability becomes higher.

A modified example of the Fourth Embodiment is a case where a linear slit (second slit) 56, whose end is formed in a semicircular shape, is provided on the outer side of the U-shaped slit (first slit) 53 of an insertion part 55 along the outer shape of a conductive arm part 57, as shown in FIGS. 16(A) and 16(B). This can lead to further reduction in plastic deformation. It is to be noted that the outer shape of this conductive arm part 57 is linearly inclined such that the width Y orthogonal to the insertion groove 34 increases in accordance with the distance X.

A fifth Embodiment is a case where the arc-like notched part 30 is provided at the end 26 of the insertion groove 34, while the U-shaped slit 53 surrounding this arc-like notched part 30 and extending along the insertion groove 34 is provided, in the insertion part 31 according to Second Embodiment shown in FIGS. 11(A) and 11(B), as shown in FIGS. 17(A) and 17(B). Hence the conductive arm part 33 can be regarded as two elastic bodies separated by the slit 53, so as to further reduce the plastic deformation.

Stress at the point X of a conductive arm part 48 of an insertion part 47 shown in FIGS. 18(A) and 18(B) of Sixth Embodiment can be expressed as follows:

$$\sigma=(6\times W\times X)/(Y^2\times b) \qquad \text{Formula (6)}$$

At this time, when the width Y is substantially uniform and the thickness b is proportional to the distance X as in FIGS. 18(A) and 18(B), the stress a is constant in the conductive arm part 48 and stress is thus efficiently dispersed, thereby to allow reduction in plastic deformation.

Further, a pair of pressing-in notches 90 may be formed in positions (contact parts 34*a* with the electrical wire 6) opposed to the insertion groove 34, as in a Seventh Embodiment shown in FIGS. 19(A) and 19(B). This pressing-in notch 90 has an arc shape curved outward. In addition, although the pair of pressing-in notches 90 has been formed in the present embodiment, this is not restrictive, and either one of the pressing-in notches 90 may be provided. Further, a shape of the pressing-in notch 90 is not particularly restricted, and may only be such a shape as to allow the conductor 6 to be pressed and fixed thereinto.

Figure 20:
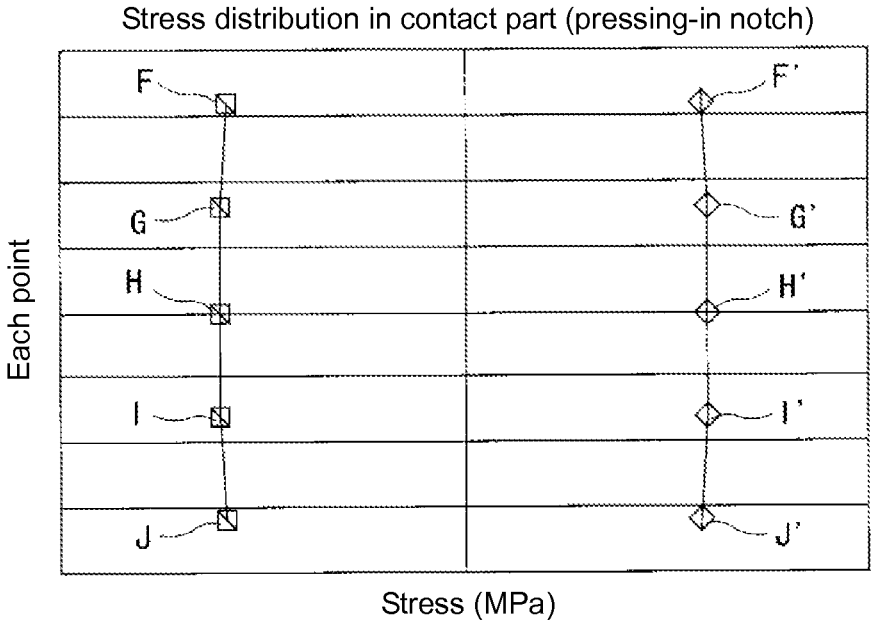
FIG. 20 is a graph showing reaction force from a conductor which is distributed to each point of the pressing-in notch.
Figure 21:
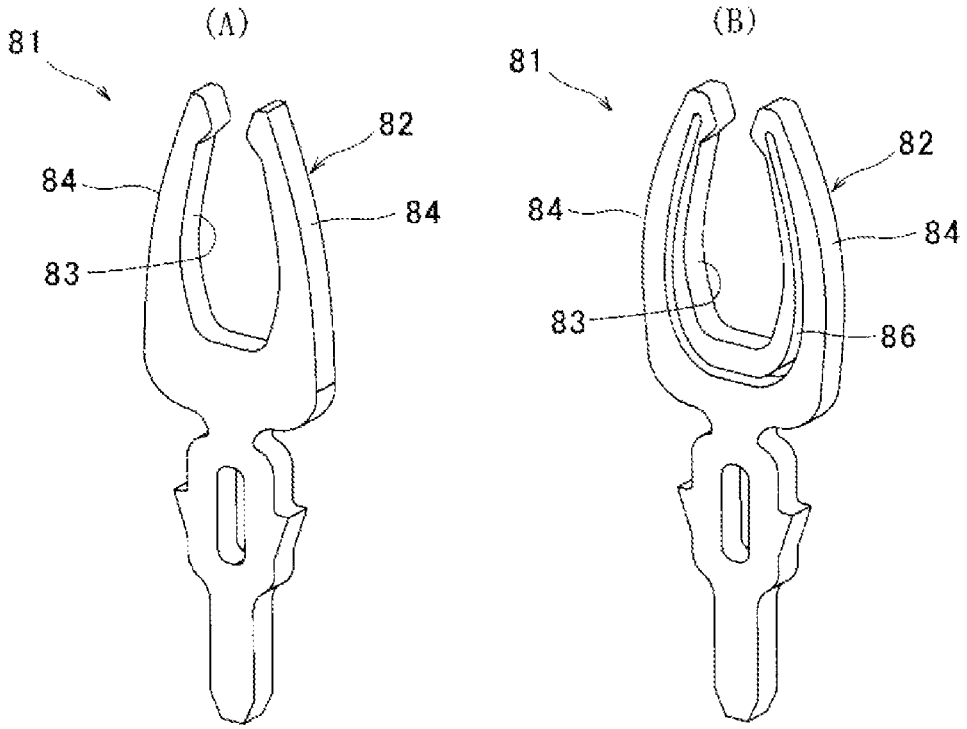
FIGS. 21(A) and 21(B) show a terminal according to Eighth Embodiment.
Figure 22:
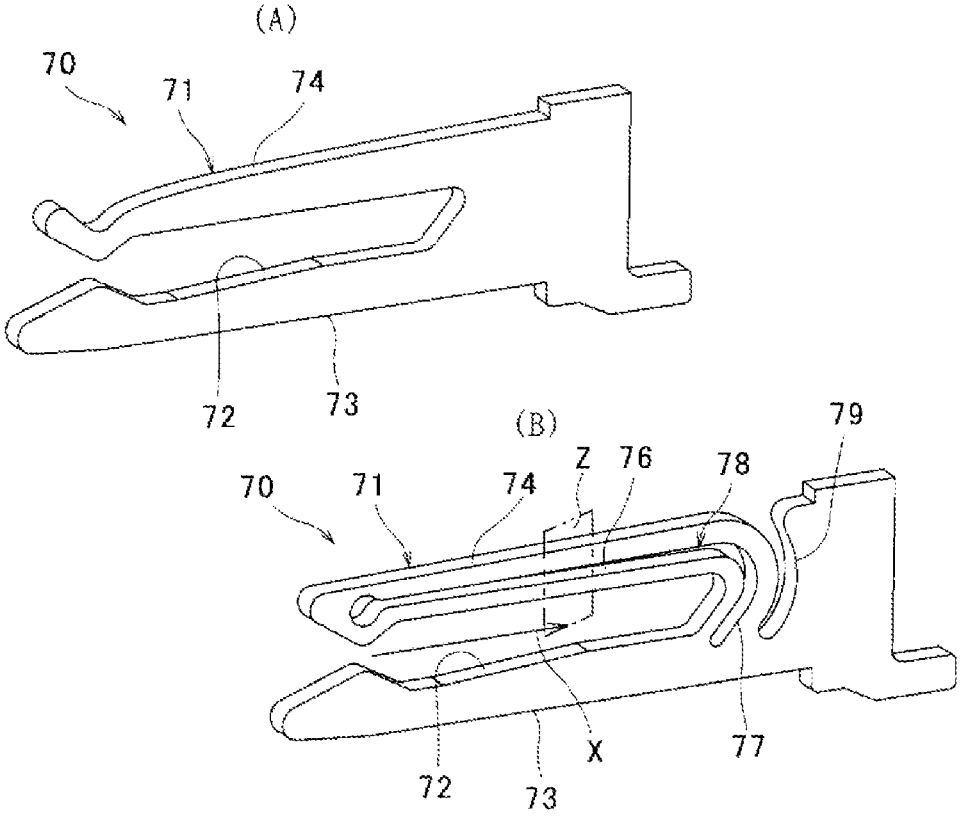
FIGS. 22(A) and 22(B) show a terminal according to Ninth Embodiment.

The present inventors conducted analysis of reaction force from each of the conductors 6 distributed to points, F, F', G, G', H, H', I, I', J and J' of the pressing-in notch 90. FIG. 20 shows analysis results. It was found that reaction force from the conductor 6 is uniformly distributed to each of the above points, as shown in FIG. 20.

Although the insertion part 12 has been applied to the terminal 11 for use in the connector 1 to connect the electrical wire 6 in the above embodiment, this is not restrictive.

For example, as in an Eighth Embodiment shown in FIG. 21(A), the insertion part of the present invention may be applied to a card edge/plug-in connector 81 for inserting an extension card of a PC thereinto.

This insertion part 82 is provided with a substantially oval insertion groove 83 for inserting the extension card thereinto, and a pair of conductive arm parts 84 symmetrically formed with this insertion groove 83 provided therebetween. Since the conductive arm part 84 has a shape approximate to that of the beam with uniform strength, it is possible to obtain a similar effect.

Further, as a modified example of the Eighth Embodiment shown in FIG. 21(B), a substantially U-shaped slit 86 which extends along the insertion groove 83 may be provided in the conductive arm part 84.

On the other hand, as in a Ninth Embodiment shown in FIG. 22(A), the insertion part of the present invention may be applied to a connector connection terminal 70 for connecting a flexible print substrate.

This insertion part 71 is provided with: an insertion groove 72 for inserting a flexible print substrate thereinto (not shown); a fixed piece 73 which extends below the insertion groove 72 and is fixed to a housing (not shown); and a conductive arm part 74 opposed to the fixed piece 73 with the insertion groove 72 provided therebetween. Since the conductive arm part 74 has a shape approximate to that of the beam with uniform strength, it is possible to obtain a similar effect.

Moreover, as a modified example of the Ninth Embodiment shown in FIG. 22(B), the conductive arm part 74 of the insertion part 71 may be provided with: a J-shaped slit 78 formed of a linear slit 76 extending along the insertion groove 72 and an insertion groove-side slit 77 extending from the end of this slit 76 and surrounding the end of the insertion groove 72; and a curved slit 79 curved along the insertion groove-side slit 77. This is formed so as to make that the section modulus Z proportional to the distance X at a point reached by moving just the distance X from the opening, by expanding the width of the J-shaped slit 78 from the opening of the insertion groove 72 toward the deeper side.

As discussed above, the invention provides a terminal in which an insertion groove for pressing a conductor thereinto is provided between a pair of conductive arm parts, wherein, when t represents a distance from the center of a contact part between the conductive arm part and the conductor to the end of the conductive arm part at the time of pressing-in of the conductor, h represents a width of the conductive arm part at the end thereof, and Y represents a width between an arbitrary position of the insertion groove and the outer edge of the conductive arm part, the following relation holds:

$$\text{at a point of } (1/2)\times t,\ Y=(h/\sqrt{2})\times(0.8 \text{ to } 1.2).$$

With the above configurations, since stress that is applied to the conductive arm parts becomes constant, plastic deformation is not apt to occur, and holding force does not decrease even when the electrical wire is once pulled out of the insertion groove and reinserted thereinto, thus leading to improvement in repairability.

As for the width Y, the outer edge of the conductive arm part may have a curved shape outwardly projecting from the end of the insertion groove toward the center of the contact part.

When X represents a distance from the center of the contact part toward the end and Z represents a section modulus of the conductive arm part at a point of the distance X, Z may be proportional to X.

Therefore, stress that is acted on the cross section at the point of the distance X becomes constant even when a load is applied to an opening of the insertion groove. This can prevent the stress from concentrating on a specific place of the terminal, so as to reduce the plastic deformation. Accordingly, the holding force does not decrease even when the electrical wire is once pulled out of the insertion groove and reinserted thereinto, thus leading to improvement in repairability.

As for the distance X, the width Y and the thickness b of the conductive arm part, $Y^2$ may be proportional to the distance X in the case of b being constant.

Therefore, the conductive arm part is elastically deformed by a small load as compared with the conventional terminal. Hence a load required at the time of pressing the electrical wire into the insertion groove is small, thus enhancing pressing-in of the electrical wire. Further, the shape of the terminal is simplified, thereby facilitating production and allowing reduction in production cost.

In a terminal in which an insertion groove for pressing a conductor thereinto is provided between a pair of conductive arm parts, when X represents a distance from the center of a contact part between the conductive arm part and the conductor to the inside at the time of pressing-in of the conductor; Y represents a width between the insertion groove at a point of the distance X and the outer edge of the conductive arm part; and b represents a thickness of the conductive arm part, b is proportional to X in the case of Y being substantially constant.

Therefore, stress that is acted on the cross section at the point of the distance X becomes constant even when a load is applied to an opening of the insertion groove. This can prevent the stress from concentrating on a specific place of the terminal, so as to reduce the plastic deformation. Accordingly, the holding force does not decrease even when the electrical wire is once pulled out of the insertion groove and reinserted thereinto, thus leading to improvement in repairability. Further, the shape of the terminal is simplified, thereby facilitating production and allowing reduction in production cost.

A plurality of slits may be provided in the conductive arm part, and the plurality of slits may be disposed such that the slit provided in a position closest to the insertion groove has the maximal length and the slits sequentially have smaller lengths as being more distant from the insertion groove.

A slit may be provided in a portion located on the deeper side than the end of the insertion groove.

Therefore, the conductive arm part becomes apt to be elastically deformed at the time of applying a load for expanding the opening of the insertion groove, to disperse stress that concentrates on the end of the insertion groove, so as to prevent stress concentration.

A notched part with a width larger than a width of the insertion groove may be provided at the end of the insertion groove.

Therefore, by application of a load, force of a vertical component and vertical force generated by the load cancel each other, out of a horizontal component and the vertical component of force generated at each end of the arc-like notched part, and hence it is possible to disperse stress that concentrates on the end of the insertion groove, so as to prevent stress concentration.

A reinforcing part may be provided between the conductive arm part and the end of the peeling part configured to remove a coated material of the conductor.

By providing the reinforcing part, it is possible to improve supporting strength of the peeling part.

A first slit extending along the insertion groove and surrounding the end of the insertion groove may be provided in the conductive arm part.

This facilitates elastic deformation of the conductive arm part to reduce the plastic deformation that occurs at the time of applying a load to the opening of the insertion groove, while allowing dispersion of stress that concentrates on the end of the insertion groove.

A second slit may be provided between the outer edge of the conductive arm part and the first slit.

This can lead to further reduction in plastic deformation.

A pressing-in notch for pressing and fixing the conductor thereinto may be formed on at least one side of the contact parts.

Therefore, reaction force by the pressed/fixed conductor is uniformly distributed to the pressing-in notch.

A pair of pressing-in notches for pressing and fixing the conductor thereinto may be formed in opposed positions of the contact parts.

Therefore, reaction force by the conductor is uniformly distributed to the pressing-in notch.

The pressing-in notch may be an arc curved outward.

Therefore, reaction force by the pressed/fixed conductor is uniformly distributed to the pressing-in notch in a more reliable manner.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A terminal, comprising:

an insertion groove for pressing a conductor thereinto disposed between a pair of conductive arm parts, wherein, when t represents a distance from a center of a contact part between a conductive arm part and the conductor to an end of the conductive arm part at a time when the conductor has completely entered the insertion groove for the first time;

h represents a width of the conductive arm part at the end thereof;

Y represents a width of the conductive arm part as an arbitrary position of the insertion groove and an outer edge of the conductive arm part, the following relation holds:

$$\text{at a point of } (1/2)\times t,\ Y=(h/\sqrt{2})\times(0.8 \text{ to } 1.2);$$

a plurality of slits are provided in the conductive arm part; and the plurality of slits are disposed such that the slit provided in a position closest to the insertion groove comprises a maximal length and the slits sequentially have smaller lengths as being more distant from the insertion groove.

2. The terminal according to claim 1, wherein, as for the width Y, the outer edge of the conductive arm part comprises a curved shape outwardly projecting from an end of an insertion groove side toward the center of the contact part.

3. The terminal according to claim 1, wherein, as for the distance X, the width Y and a thickness b of the conductive arm part, $Y^2$ is proportional to the X in the case of b being constant.

4. The terminal according to claim 1, wherein a slit is provided in a portion located on a deeper side than the end of the insertion groove.

5. The terminal according to claim 1, further comprising a notched part with a width larger than a width of the insertion groove disposed at the end of the insertion groove.

6. The terminal according to claim 1, further comprising a reinforcing part disposed between the conductive arm part and an end of a peeling part configured to remove a coated material of the conductor.

7. The terminal according to claim 1, further comprising a first slit disposed in the conductive arm part extending along the insertion groove and surrounding the end of the insertion groove.

8. The terminal according to claim 7, further comprising a second slit disposed between the outer edge of the conductive arm part and the first slit.

9. The terminal according to claim 1, further comprising a pressing-in notch for pressing and fixing the conductor thereinto disposed on at least one side of the contact part.

10. The terminal according to claim 9, wherein a pair of pressing-in notches for pressing and fixing the conductor thereinto is disposed on a side of an opposing contact part.

11. The terminal according to claim 9, wherein the pressing-in notch is an arc curved outward.

12. The terminal according to claim 10, wherein the pressing-in notch is an arc curved outward.

13. A terminal, comprising:

an insertion groove for pressing a conductor thereinto disposed between a pair of conductive arm parts, wherein, when X represents a distance from a center of a contact part between a conductive arm part and the conductor to an inside at a time when the conductor has completely entered the insertion groove for the first time;

Y represents a width of the conductive arm part as an arbitrary position from the end;

b represents a thickness of the conductive arm part, b is proportional to X in the case of Y being substantially constant;

a plurality of slits are provided in the conductive arm part; and the plurality of slits are disposed such that the slit provided in a position closest to the insertion groove comprises a maximal length and the slits sequentially have smaller lengths as being more distant from the insertion groove.

14. The terminal according to claim 2, wherein, as for the distance X, the width Y and a thickness b of the conductive arm part, $Y^2$ is proportional to the X in the case of b being constant.

15. The terminal according to claim 13, wherein a slit is provided in a portion located on a deeper side than the end of the insertion groove.

16. The terminal according to claim 13, further comprising a notched part with a width larger than a width of the insertion groove disposed at the end of the insertion groove.

17. The terminal according to claim 13, further comprising a first slit disposed in the conductive arm part extending along the insertion groove and surrounding the end of the insertion groove.

18. The terminal according to claim 17, further comprising a second slit disposed between the outer edge of the conductive arm part and the first slit.

19. The terminal according to claim 13, further comprising a pressing-in notch for pressing and fixing the conductor thereinto disposed on at least one side of the contact part.

20. The terminal according to claim 19, wherein a pair of pressing-in notches for pressing and fixing the conductor thereinto is disposed on a side of an opposing contact part.

21. The terminal according to claim 19, wherein the pressing-in notch is an arc curved outward.

22. The terminal according to claim 20, wherein the pressing-in notch is an arc curved outward.

* * * * *